US011118255B2

(12) United States Patent
Fujii et al.

(10) Patent No.: US 11,118,255 B2
(45) **Date of Patent: *Sep. 14, 2021**

(54) CU-AL-MN-BASED ALLOY MATERIAL, METHOD OF PRODUCING THE SAME, AND ROD MATERIAL OR SHEET MATERIAL USING THE SAME

(71) Applicants: FURUKAWA ELECTRIC CO., LTD., Tokyo (JP); FURUKAWA TECHNO MATERIAL CO., LTD., Hiratsuka (JP); Tohoku University, Sendai (JP)

(72) Inventors: Misato Fujii, Hiratsuka (JP); Sumio Kise, Hiratsuka (JP); Toyonobu Tanaka, Hiratsuka (JP); Kenji Nakamizo, Hiratsuka (JP); Koji Ishikawa, Hiratsuka (JP); Toshihiro Omori, Sendai (JP); Ryosuke Kainuma, Sendai (JP)

(73) Assignees: FURUKAWA ELECTRIC CO., LTD., Tokyo (JP); FURUKAWA TECHNO MATERIAL CO., LTD., Hiratsuka (JP); TOHOKU UNIVERSITY, Sendai (JP)

( * ) Notice: Subject to any disclaimer, the term of this patent is extended or adjusted under 35 U.S.C. 154(b) by 1006 days.

This patent is subject to a terminal disclaimer.

(21) Appl. No.: 15/264,113

(22) Filed: Sep. 13, 2016

(65) Prior Publication Data

US 2016/0376688 A1 Dec. 29, 2016

Related U.S. Application Data

(63) Continuation of application No. PCT/JP2015/056856, filed on Mar. 9, 2015.

(30) Foreign Application Priority Data

Mar. 14, 2014 (JP) ..... JP2014-052462

(51) Int. Cl.
*C22F 1/08* (2006.01)
*C22C 9/01* (2006.01)
(Continued)

(52) U.S. Cl.
CPC ..... *C22F 1/08* (2013.01); *B22D 21/005* (2013.01); *C22C 1/02* (2013.01); *C22C 9/01* (2013.01); *C22C 9/05* (2013.01)

(58) Field of Classification Search
CPC ..... C22F 1/08
See application file for complete search history.

(56) References Cited

U.S. PATENT DOCUMENTS 6,406,566 B1 * 6/2002 Ishida ..... C22C 9/01 148/402
2013/0087074 A1 4/2013 Araki et al.
(Continued)

FOREIGN PATENT DOCUMENTS

JP 07-062472 A 3/1995
JP 2000-169920 A 6/2000
(Continued)

OTHER PUBLICATIONS

International Search Report for PCT/JP2015/056856 (PCT/ISA/210) dated Jun. 9, 2015.
(Continued)

*Primary Examiner* — Jophy S. Koshy
(74) *Attorney, Agent, or Firm* — Birch, Stewart, Kolasch & Birch, LLP

(57) ABSTRACT

A Cu—Al—Mn-based alloy material (1) having a composition comprising: given contents of Al and Mn, and a given total content of at least one selected from Ni and the like; with the balance being Cu and unavoidable impurities, wherein the alloy material has a shape elongated in the working direction (RD), wherein a grain length $a_x$ in the RD
(Continued)

is R/2 or less to the width or diameter (R), a grain length $b_x$ in a direction perpendicular to the RD is R/4 or less, and the amount of grains X (2) is 15% or less, and wherein a grain length a in the RD and a grain length b in the direction perpendicular to the RD satisfy: a≥b, and an angle formed by the normal line of the (111) plane and the RD is 15° or larger, the amount of grains Y' (3) is 85% or more.

3 Claims, 5 Drawing Sheets

(51) Int. Cl.

| | |
|---|---|
| ***C22C 9/05*** | (2006.01) |
| ***B22D 21/00*** | (2006.01) |
| ***C22C 1/02*** | (2006.01) |

(56) References Cited

U.S. PATENT DOCUMENTS

| | | | |
|---|---|---|---|
| 2015/0225826 | A1 | 8/2015 | Omori et al. |
| 2016/0130683 | A1 | 5/2016 | Kise et al. |

FOREIGN PATENT DOCUMENTS

| | | | |
|---|---|---|---|
| JP | 2001-020026 | A | 1/2001 |
| JP | 2003-138330 | A | 5/2003 |
| JP | 2005-298952 | A | 10/2005 |
| JP | 2014-218717 | A | 11/2014 |
| JP | 2015-054977 | A | 3/2015 |
| WO | WO 2011/152009 | A1 | 12/2011 |
| WO | WO 2014/042160 | A1 | 3/2014 |
| WO | WO 2015/008689 | A1 | 1/2015 |

OTHER PUBLICATIONS

Written Opinion of the International Searching Authority for PCT/JP2015/056856 (PCT/ISA/237) dated Jun. 9, 2015.

Extended European Search Report, dated Nov. 27, 2017, for European Application No. 15761245.8.

Sotou et al., "Development of Cu-Al-Mn-based Shape Memory Alloys with Enhanced Ductility," Materia Japan, vol. 42, No. 11, Nov. 20, 2003, pp. 813-821, XP055294456.

Sotou et al., "Grain Size Dependence of Pseudoelasticity in Polycrystalline Cu-Al-Mn-based Shape Memory Sheets," Acta Materialia, vol. 61, No. 10, 2013 (Available online Apr. 10, 2013), pp. 3842-3850, XP028591114.

* cited by examiner

Comparative Example 1 Process No. A

Example 1 Process No. a

Note: RT is room temperature

Example 1 Process No. a

[1] Melting and casting

Comparative Example 1 Process No. A

[1] Melting and casting

| | Ex 1 Process a | CEx 1 Process A |
|---|---|---|
| [2] | 800°C | 800°C |
| [3] | 550°C | 550°C |
| [4] | 120 min | 120 min |
| [5] | 30% | 30% |
| [6] | 3 times (65%) | 3 times (65%) |
| [7] | 30°C/min | 30°C/min |
| [8] | 500°C | 500°C |
| [9] | 60 min | 60 min |
| [10] | 1°C/min | 1°C/min |
| [11] | 900°C | 900°C |
| [12] | 120 min | 120 min |
| [13] | 1°C/min | 1°C/min |
| [14] | 500°C | 500°C |
| [15] | 60 min | 60 min |
| [16] | 1°C/min | 1°C/min |
| [17] | 900°C | 900°C |
| [18] | 120 min | 120 min |
| [19] | 2 times | 1 time |
| [20] | 50°C/sec | 50°C/sec |
| [21] | 150°C | 150°C |
| [22] | 20 min | 20 min |

Example 1 Process No. a

Comparative Example 1 Process No. A

Example 1 Process No. a

Comparative Example 1 Process No. A

CU-AL-MN-BASED ALLOY MATERIAL, METHOD OF PRODUCING THE SAME, AND ROD MATERIAL OR SHEET MATERIAL USING THE SAME

CROSS-REFERENCE TO RELATED APPLICATIONS

This application is a Continuation of PCT International Application No. PCT/JP2015/056856 filed on Mar. 9, 2015, which claims priority under 35 U.S.C. § 119 (a) to Japanese Patent Application No. 2014-052462 filed in Japan on Mar. 14, 2014. Each of the above applications is hereby expressly incorporated by reference, in its entirety, into the present application.

TECHNICAL FIELD

The present invention relates to a Cu—Al—Mn-based alloy material having excellent resistance to repeated deformations, a method of producing the alloy material, and a rod material or a sheet material using the alloy material.

BACKGROUND ART

Shape memory alloys/superelastic alloys, such as copper alloys, exhibit a remarkable shape memory effect and superelastic characteristics concomitantly to reverse transformation of the thermoelastic martensite transformation, and have excellent functions near the living environment temperature. Accordingly, these alloys have been put to practical use in various fields. Representative alloys of the shape memory alloys/superelastic alloys include TiNi alloys and copper (Cu)-based alloys. Copper-based shape memory alloys/superelastic alloys (hereinafter, these are also collectively refer to, simply, copper-based alloys) have characteristics inferior to those of TiNi alloys in terms of repetition characteristics, corrosion resistance, and the like. On the other hand, since the cost is inexpensive, there has been a movement to extend the application range of copper-based alloys. However, although copper-based alloys are advantageous in terms of cost, those alloys are poor in cold workability and inferior in superelastic characteristics. For this reason, despite that a variety of studies are being conducted, it is the current situation that practicalization of copper-based alloys has not been necessarily sufficiently progressed.

Heretofore, various investigations have been conducted on copper-based alloys. For example, Cu—Al—Mn-based shape memory alloys having a β single phase structure with excellent cold workability, have been reported in Patent Literatures 1 to 4 described below. In those examples, for example, regarding a crystalline orientation, the copper-based alloys have a recrystallized texture in which particular orientations, such as <101> and <100>, of a β single phase metallic texture, are aligned in the direction of cold-working, such as rolling or wire-drawing.

CITATION LIST

Patent Literatures

Patent Literature 1: JP-A-7-62472 ("JP-A" means unexamined published Japanese patent application)
Patent Literature 2: JP-A-2000-169920
Patent Literature 3: JP-A-2001-20026
Patent Literature 4: WO 2011/152009 A1

SUMMARY OF INVENTION

Technical Problem

A Cu—Al—Mn-based alloy produced by the method of Patent Literature 1 does not have satisfactory characteristics, particularly superelastic characteristics, and the maximum given strain that exhibits shape recovery of 90% or more is about 2 to 3%. Regarding the reason for this, it is speculated that because a strong restraining force is generated among crystal grains at the time of deformation due to reasons, such as the crystalline orientation being random, irreversible defects, such as transition, are introduced. Thus, residual strain that is accumulated due to repeated deformations occurs to a large extent, and after repeated deformations, deterioration of superelastic characteristics also becomes noticeable.

Further, the copper-based alloy of Patent Literature 2 is a copper-based alloy which has shape memory characteristics and superelastic characteristics and which is substantially formed of a β single phase, and the crystal structure is a recrystallized texture in which in the crystalline orientation of the β single phase, particular crystalline orientations, such as <101> and <100>, of the β single phase are aligned in the direction of cold-working, such as rolling or wire-drawing. In the above-described copper-based alloy, the cold-working is performed at a total working ratio after final annealing, at which the frequency of existence of a particular crystalline orientation of the β single phase in the working direction measured by Electron Back-Scatter Diffraction Patterning (hereinafter, may be abbreviated to "EBSP") (alternatively, also referred to as Electron BackScatter Diffraction (hereinafter, also abbreviated as EBSD)) is 2.0 or higher. Even if the alloy is such a material as described above, since the amount of transformation strain is highly dependent on orientation in Cu—Al—Mn-based alloys, it was insufficient to stably obtain satisfactory superelastic characteristics precisely and uniformly. Further, residual strain that is accumulated due to repeated deformations occurs to a large extent, and after repeated deformations, deterioration of superelastic characteristics also becomes noticeable.

Further, in regard to the copper-based alloys described in Patent Literature 3 and Patent Literature 4, from the viewpoint that the shape memory characteristics and the superelastic characteristics exhibited thereby have large variations in the performance, and these characteristics are not stabilized, there is room for further improvement. Further, it may be considered that in order to stabilize the shape memory characteristics and the superelastic characteristics, texture control is indispensable. However, in the method described in Patent Literature 3, the degree of integration of the texture in the Cu—Al—Mn-based alloy is low, and the shape memory characteristics and the superelastic characteristics are not yet sufficiently stabilized. In Patent Literature 3, it is proposed that the crystalline orientation of the β single phase is controlled in order to enhance the shape memory characteristics and the superelastic characteristics of the copper-based alloy, and also, the average crystal grain size is adjusted to a value equivalent to a half or greater of the wire diameter in the case of a wire material, or to a value equivalent to the sheet thickness or greater in the case of a sheet material, while the area of a region having such a crystal grain size is adjusted to 30% or more of the entire length of the wire material or the entire area of the sheet material. Further, in Patent Literature 4, in order to enhance the shape memory characteristics of the copper-based alloy, and to obtain a copper-based alloy having a cross-section size applicable to structures, it is proposed to produce a macrocrystalline crystal grain structure having a maximum crystal grain size of more than 8 mm. However, in the methods described in Patent Literature 3 and Patent Literature 4, since the control of the crystal grain size distribution of crystal grains having predetermined large crystal grain sizes is more unsatisfactory in a Cu—Al—Mn-based alloy, the shape memory effect or the superelastic characteristics are not stabilized. Further, residual strain that is accumulated due to repeated deformations occurs to a large extent, and after repeated deformations, deterioration of superelastic characteristics also becomes noticeable.

As such, it is considered that integration of the crystalline orientation and having a predetermined large crystal grain size are effective for an enhancement of superelasticity in Cu—Al—Mn-based alloys. However, in the conventional art, no improvement has been made in connection with deterioration of the superelastic characteristics in repeated deformations. However, in a case where these alloys are used for a medical tool, a construction member or the like, deterioration of the characteristics caused by repeated deformations becomes a serious problem, and there is a demand for improvement.

The present invention is implemented for providing a Cu—Al—Mn-based alloy material which has excellent resistance to repeated deformations, for providing a method of producing the same, and for providing a rod material or a sheet material using the alloy material.

Solution to Problem

The inventors of the present invention conducted a thorough investigation in order to solve the problems described above. As a result, the inventors have found that when the crystal grain size of a Cu—Al—Mn-based alloy material is controlled while the crystalline orientation of the alloy material is controlled, and when the amount of existence (existence proportion) of small crystal grains that do not grow to a predetermined size or larger is controlled, the amount of residual strain after repeated deformations can be reduced. Further, the inventors have found that the control that enables such a balance between the crystal grain size and the texture to be achieved, can be achieved by performing: a shape memory heat treatment, in which a Cu—Al—Mn-based alloy material is subjected to predetermined intermediate annealing and cold-working, then the alloy material is heated in the initial stage of a shape memory heat treatment to a temperature range, in which a state of an ($\alpha+\beta$) phase with a fixed amount of $\alpha$ phase precipitation is converted to a $\beta$ single phase at a particular slow speed of temperature raising, then the alloy material is maintained at a predetermined temperature for a predetermined time, and repeating at least two times of: cooling from a temperature range for forming a $\beta$ single phase to the temperature range for forming an ($\alpha+\beta$) phase at a particular slow speed of temperature lowering; and heating from the temperature range for forming an ($\alpha+\beta$) phase to the temperature range for forming a $\beta$ single phase at a particular slow speed of temperature raising. The present invention was completed based on these findings.

That is, the present invention is to provide the following means:

(1) A Cu—Al—Mn-based alloy material having a composition containing 3.0 to 10.0 mass % of Al, 5.0 to 20.0 mass % of Mn, and 0.000 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.000 to 3.000 mass %; the content of Co is 0.000 to 2.000 mass %; the content of Ti is 0.000 to 2.000 mass %; the contents of V, Nb, Mo, and Zr are each 0.000 to 1.000 mass %; the content of Cr is 0.000 to 2.000 mass %; the content of Si is 0.000 to 2.000 mass %; the content of W is 0.000 to 1.000 mass %; the content of Sn is 0.000 to 1.000 mass %; the content of Mg is 0.000 to 0.500 mass %; the content of P is 0.000 to 0.500 mass %; the contents of Be, Sb, Cd, and As are each 0.000 to 1.000 mass %; the content of Zn is 0.000 to 5.000 mass %; the contents of B and C are each 0.000 to 0.500 mass %; the content of Ag is 0.000 to 2.000 mass %; and the content of misch metal is 0.000 to 5.000 mass %; with the balance being Cu and unavoidable impurities, wherein the alloy material is an alloy material having a shape that is elongated in the working direction, which is the rolling direction or the wire-drawing direction, wherein in regard to a crystal grain X for which the crystal grain length $a_x$ in the working direction of the alloy material is R/2 or less with respect to the width or diameter R of the alloy material, and for which the crystal grain length $b_x$ in a direction perpendicular to the working direction is R/4 or less, the amount of existence of the crystal grains X is 15% or less of the total amount of the alloy material, and wherein in regard to a crystal grain Y', for which the crystal grain length a in the working direction and the crystal grain length bin the direction perpendicular to the working direction satisfy the relationships of $a \geq b$, and for which the angle formed by the normal line of the (111) plane of that crystal and the working direction is 15° or larger, the amount of existence of the crystal grains Y' is 85% or more of the total amount of the alloy material.

(2) The Cu—Al—Mn-based alloy material described in the item (1), wherein the Cu—Al—Mn alloy material has the composition containing 0.001 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.001 to 3.000 mass %; the content of Co is 0.001 to 2.000 mass %; the content of Ti is 0.001 to 2.000 mass %; the contents of V, Nb, Mo, and Zr are each 0.001 to 1.000 mass %; the content of Cr is 0.001 to 2.000 mass %; the content of Si is 0.001 to 2.000 mass %; the content of W is 0.001 to 1.000 mass %; the content of Sn is 0.001 to 1.000 mass %; the content of Mg is 0.001 to 0.500 mass %; the content of P is 0.010 to 0.500 mass %; the contents of Be, Sb, Cd, and As are each 0.001 to 1.000 mass %; the content of Zn is 0.001 to 5.000 mass %; the contents of B and C are each 0.001 to 0.500 mass %; the content of Ag is 0.001 to 2.000 mass %; and the content of misch metal is 0.001 to 5.000 mass %.

(3) A Cu—Al—Mn-based alloy material having a composition containing 3.0 to 10.0 mass % of Al, 5.0 to 20.0 mass % of Mn, and 0.000 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.000 to 3.000 mass %; the content of Co is 0.000 to 2.000 mass %; the content of Ti is 0.000 to 2.000 mass %; the contents of V, Nb, Mo, and Zr are each 0.000 to 1.000 mass %; the content of Cr is 0.000 to 2.000 mass %; the content of Si is 0.000 to 2.000 mass %; the content of W is 0.000 to 1.000 mass %; the content of Sn is 0.000 to 1.000 mass %; the content of Mg is 0.000 to 0.500 mass %; the content of P is 0.000 to 0.500 mass %; the contents of Be, Sb, Cd, and As are each 0.000 to 1.000 mass %; the content of Zn is 0.000 to 5.000 mass %; the contents of B and C are each 0.000 to 0.500 mass %; the content of Ag is 0.000 to 2.000 mass %; and the content of misch metal is 0.000 to 5.000 mass %; with the balance being Cu and unavoidable impurities, wherein the value of the difference between the stress value of 0.2% proof stress in the case of performing loading and unloading of stress that gives a strain of 5%, and the stress value obtainable when a strain of 5% is loaded, as determined from a stress-strain curve, is 50 MPa or less, and the amount of residual strain obtainable when loading and unloading of the stress that gives a strain of 5% is repeated 100 times, is 2.0% or less.

(4) The Cu—Al—Mn-based alloy material described in the item (3), wherein the Cu—Al—Mn alloy material has the composition containing 0.001 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.001 to 3.000 mass %; the content of Co is 0.001 to 2.000 mass %; the content of Ti is 0.001 to 2.000 mass %; the contents of V, Nb, Mo, and Zr are each 0.001 to 1.000 mass %; the content of Cr is 0.001 to 2.000 mass %; the content of Si is 0.001 to 2.000 mass %; the content of W is 0.001 to 1.000 mass %; the content of Sn is 0.001 to 1.000 mass %; the content of Mg is 0.001 to 0.500 mass %; the content of P is 0.010 to 0.500 mass %; the contents of Be, Sb, Cd, and As are each 0.001 to 1.000 mass %; the content of Zn is 0.001 to 5.000 mass %; the contents of B and C are each 0.001 to 0.500 mass %; the content of Ag is 0.001 to 2.000 mass %; and the content of misch metal is 0.001 to 5.000 mass %.

(5) The Cu—Al—Mn-based alloy material described in any one of the items (1) to (4), wherein among the crystal grains Y', in regard to a crystal grain Z' in which the angle formed by the normal line of the (101) plane of the crystal and the working direction is 20° or less, the amount of existence of the crystal grains Z' is 50% or more of the total amount of the alloy material.

(6) A method of producing a Cu—Al—Mn-based alloy material, comprising the steps of:

melting and casting of a raw material of a Cu—Al—Mn-based alloy material having a composition containing 3.0 to 10.0 mass % of Al, 5.0 to 20.0 mass % of Mn, and 0.000 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.000 to 3.000 mass %; the content of Co is 0.000 to 2.000 mass %; the content of Ti is 0.000 to 2.000 mass %; the contents of V, Nb, Mo, and Zr are each 0.000 to 1.000 mass %; the content of Cr is 0.000 to 2.000 mass %; the content of Si is 0.000 to 2.000 mass %; the content of W is 0.000 to 1.000 mass %; the content of Sn is 0.000 to 1.000 mass %; the content of Mg is 0.000 to 0.500 mass %; the content of P is 0.000 to 0.500 mass %; the contents of Be, Sb, Cd, and As are each 0.000 to 1.000 mass %; the content of Zn is 0.000 to 5.000 mass %; the contents of B and C are each 0.000 to 0.500 mass %; the content of Ag is 0.000 to 2.000 mass %; and the content of misch metal is 0.000 to 5.000 mass %; with the balance being Cu and unavoidable impurities;

performing hot-working;

performing at least once of intermediate annealing at 400° C. to 680° C. for 1 to 120 minutes and cold-working at a working ratio of 30% or more, in this order; and heating from room temperature to a temperature range for obtaining an (α+β) phase, then maintaining in this temperature range for 2 to 120 minutes, heating from the temperature range for obtaining the (α+β) phase to a temperature range for obtaining a β single phase at a speed of temperature raising of 0.1° C./min to 20° C./min, maintaining in this temperature range for 5 to 480 minutes, then cooling from the temperature range for obtaining the β single phase to the temperature range for obtaining the (α+β) phase at a speed of temperature lowering of 0.1° C./min to 20° C./min, maintaining in this temperature range for 20 to 480 minutes, then heating from the temperature range for obtaining the (α+β) phase to the temperature range for obtaining the β single phase at a speed of temperature raising of 0.1° C./min to 20° C./min, and maintaining in this temperature range for 5 to 480 minutes, and then rapidly cooling;

wherein the series of steps: from maintaining in the temperature range for obtaining a β single phase, then cooling from the temperature range for obtaining a β single phase to the temperature range for obtaining an (α+β) phase at a speed of temperature lowering of 0.1° C./min to 20° C./min, and maintaining in this temperature range for 20 to 480 minutes; to heating from the temperature range for obtaining an (α+β) phase to the temperature range for obtaining a β single phase at a speed of temperature raising of 0.1° C./min to 20° C./min, and maintaining in this temperature range for 5 to 480 minutes, is repeated at least two times.

(7) The method of producing a Cu—Al—Mn-based alloy material described in the item (6), wherein the Cu—Al—Mn alloy material has the composition containing 0.001 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.001 to 3.000 mass %; the content of Co is 0.001 to 2.000 mass %; the content of Ti is 0.001 to 2.000 mass %; the contents of V, Nb, Mo, and Zr are each 0.001 to 1.000 mass %; the content of Cr is 0.001 to 2.000 mass %; the content of Si is 0.001 to 2.000 mass %; the content of W is 0.001 to 1.000 mass %; the content of Sn is 0.001 to 1.000 mass %; the content of Mg is 0.001 to 0.500 mass %; the content of P is 0.010 to 0.500 mass %; the contents of Be, Sb, Cd, and As are each 0.001 to 1.000 mass %; the content of Zn is 0.001 to 5.000 mass %; the contents of B and C are each 0.001 to 0.500 mass %; the content of Ag is 0.001 to 2.000 mass %; and the content of misch metal is 0.001 to 5.000 mass %.

(8) A method of producing a Cu—Al—Mn-based alloy material, which has a composition containing 3.0 to 10.0 mass % of Al, 5.0 to 20.0 mass % of Mn, and 0.000 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.000 to 3.000 mass %; the content of Co is 0.000 to 2.000 mass %; the content of Ti is 0.000 to 2.000 mass %; the contents of V, Nb, Mo, and Zr are each 0.000 to 1.000 mass %; the content of Cr is 0.000 to 2.000 mass %; the content of Si is 0.000 to 2.000 mass %; the content of W is 0.000 to 1.000 mass %; the content of Sn is 0.000 to 1.000 mass %; the content of Mg is 0.000 to 0.500 mass %; the content of P is 0.000 to 0.500 mass %; the contents of Be, Sb, Cd, and As are each 0.000 to 1.000 mass %; the content of Zn is 0.000 to 5.000 mass %; the contents of B and C are each 0.000 to 0.500 mass %; the content of Ag is 0.000 to 2.000 mass %; and the content of misch metal is 0.000 to 5.000 mass %; with the balance being Cu and unavoidable impurities;

wherein the alloy material is an alloy material having a shape that is elongated in the working direction, which is the rolling direction or the wire-drawing direction, wherein in regard to a crystal grain X for which the crystal grain length $a_x$ in the working direction of the alloy material is R/2 or less with respect to the width or diameter R of the alloy material, and for which the crystal grain length $b_x$ in a direction perpendicular to the working direction is R/4 or less, the amount of existence of the crystal grains X is 15% or less of the total amount of the alloy material, and wherein in regard to a crystal grain Y, for which the crystal grain length a in the working direction and the crystal grain length b in the direction perpendicular to the working direction satisfy the relationships of a≥b, and for which the angle formed by the normal line of the (111) plane of that crystal and the working direction is 15° or larger, the amount of existence of the crystal grains Y is 85% or more of the total amount of the alloy material.

(9) The method of producing a Cu—Al—Mn-based alloy material described in the item (8), wherein the Cu—Al—Mn alloy has the composition containing 0.001 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.001 to 3.000 mass %; the content of Co is 0.001 to 2.000 mass %; the content of Ti is 0.001 to 2.000 mass %; the contents of V, Nb, Mo, and Zr are each 0.001 to 1.000 mass %; the content of Cr is 0.001 to 2.000 mass %; the content of Si is 0.001 to 2.000 mass %; the content of W is 0.001 to 1.000 mass %; the content of Sn is 0.001 to 1.000 mass %; the content of Mg is 0.001 to 0.500 mass %; the content of P is 0.010 to 0.500 mass %; the contents of Be, Sb, Cd, and As are each 0.001 to 1.000 mass %; the content of Zn is 0.001 to 5.000 mass %; the contents of B and C are each 0.001 to 0.500 mass %; the content of Ag is 0.001 to 2.000 mass %; and the content of misch metal is 0.001 to 5.000 mass %.

(10) The method of producing a Cu—Al—Mn-based alloy material described in any one of the items (6) to (9), wherein after the rapid cooling, an aging heat treatment is carried out at 70° C. to 300° C. for 5 to 120 minutes.

(11) A rod material or a sheet material, which is formed from the Cu—Al—Mn-based alloy material described in any one of the items (1) to (5).

Herein, 'having excellent resistance to repeated deformations' means that the amount of residual strain obtainable after loading and unloading at a predetermined amount of strain is repeated at predetermined times, is small, and it is more desirable if this residual strain is smaller. According to the present invention, it means that in regard to repeated deformations, by which loading and unloading of a strain equivalent to an amount of strain of 5% is repeated 100 times, the amount of residual strain is 2.0% or less, and preferably 1.5% or less.

Advantageous Effects of Invention

The Cu—Al—Mn-based superelastic alloy material of the present invention can be used in various applications where superelastic characteristics are required, and for example, applications to antennae of mobile telephones, spectacle frames; medical products, such as orthodontic wires, guide wires, stents, ingrown nail correctors (onychocryptosis correctors), and hallux valgus orthoses; as well as connectors and actuators, are expected. Further, the Cu—Al—Mn-based superelastic alloy material of the present invention is preferable as a vibration damping material, such as a bus bar, or as a construction material, due to its excellent resistance to repeated deformations. Further, vibration damping structures and the like can be constructed, using this vibration damping material or construction material. In addition, the alloy material can also be utilized as a civil engineering and construction material enabling prevention of pollutions, such as noises and vibrations, by utilizing the characteristics of absorbing vibrations as described above. The alloy material can also be used as a vibration-absorbing member for aircrafts or automobiles. The alloy material can also be applied in the field of transportation equipment intended for an effect of noise reduction.

Other and further features and advantages of the invention will appear more fully from the following description, appropriately referring to the accompanying drawings.

BRIEF DESCRIPTION OF DRAWINGS

FIG. 2(*a*) shows an inverse pole figure based on the results of Comparative Example 1 that will be described below. The marked portion in the inverse pole figure of FIG. 2(*b*) represents a region in which the angle formed by the normal line of the (111) plane shown in FIG. 2(*a*) described above and the working direction is 15° or more, as well as a region in which the angle formed by the normal line of the (101) plane and the working direction is 20° or less. A crystal grain, which is within this overlapping region and has crystal grain lengths that satisfy the relationships of a≥b, is crystal grain Z' (or crystal grain Z in the state of the mid course). FIG. 2(*b*) shows an inverse pole figure based on the results of Example 1 that will be described below.

FIG. 4(*a*) shows the respective S-S curves of at a time point at which the first cycle has been completed (solid line in the diagram) and a time point at which the 100th cycle has been completed (dotted line in the diagram), obtainable after a test of repeating 100 cycles of loading and unloading of 5% strain, and the respective residual strains at the time of completions of the first cycle and the 100th cycle are shown in the diagram. FIG. 4(*b*) is an S-S curve obtainable after a test of loading and unloading of 5% strain, and the "difference of stress" of the stress value at the time of loading of 5% strain with respect to the 0.2% proof stress is shown in the diagram.

MODE FOR CARRYING OUT THE INVENTION

Figure 1:
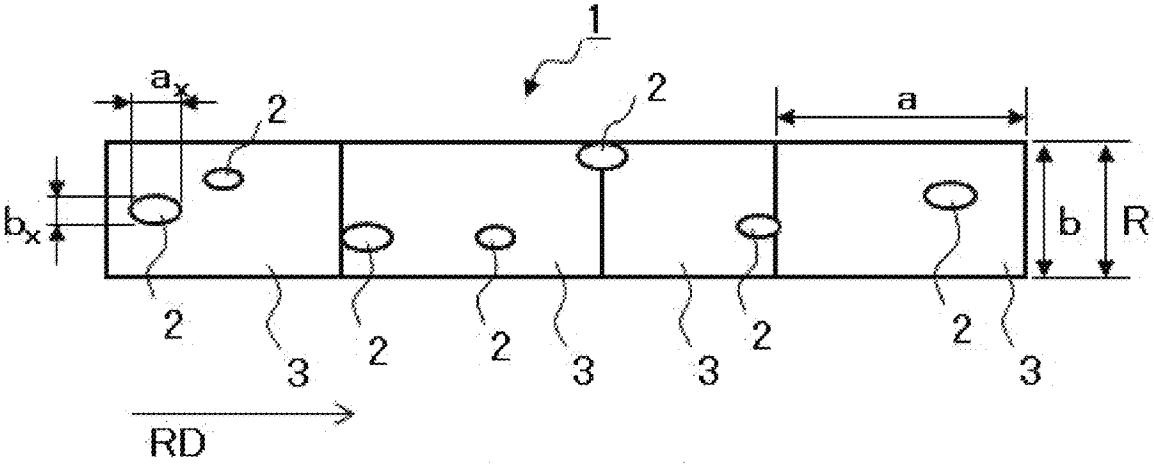
FIG. 1 is a schematic diagram for a Cu—Al—Mn-based alloy rod material (wire material) 1 of the present invention, the schematic diagram explaining the relationships between the crystal grain lengths (a, b) of a large crystal grain 3 (crystal grain Y', crystal grain Z', and the like in the final state, or crystal grains Y and Z in the state of the mid course) as well as the crystal grain lengths ($a_x$, $b_x$) of a small crystal grain 2 (crystal grain X) as defined in the present invention, and the material width or diameter (R).

The Cu—Al—Mn-based alloy material of the present invention is subjected through predetermined intermediate annealing and cold-working, and further via maintaining [Step 5-2] in a temperature range for obtaining an (α+β) phase, which is carried out before the heating [Step 5-3] to a temperature range for obtaining a β single phase that is initially obtained by a shape memory heat treatment, so that the amount of α phase precipitation is fixed thereby. Then, the Cu—Al—Mn-based alloy material is subjected to the shape memory heat treatment, in which cooling [Step 5-5] from the temperature range for obtaining the β single phase to the temperature range for obtaining the (α+β) phase at a particular slow speed of temperature lowering, and heating [Step 5-7] from the temperature range for obtaining the (α+β) phase to the temperature range for obtaining the β single phase at a particular slow speed of temperature raising, are repeated at least two times. Thereby, while the crystalline orientation is controlled in a texture that is oriented to a direction other than the <111> direction, which is a crystalline orientation with high induced stress (that is, the amount of existence of crystal grains in which the angle formed by the normal line of the (111) plane and the working direction (RD) is as small as less than 15° is small), the crystal grain size of crystal grains having a large crystal grain size (the crystal grains Y' and Z' in the final state, or the crystal grains Y and Z in the state of the mid course) is controlled to be large in the crystal grain size thereof, and the amount of existence of the crystal grains is controlled to be large. Concomitantly, the amount of existence of small crystal grains that do not grow to a predetermined size or larger (the crystal grain X) can be appropriately controlled to be small. Thus, an alloy material that provides satisfactory superelasticity even if subjected to repeated deformations, is obtained.

The working direction (RD, see FIG. 1) refers to the wire-drawing direction in the case of wire-drawing, or refers to the rolling direction in the case of rolling. Usually, the rolling direction at the time of rolling of a sheet material or the like is called RD (Rolling Direction), but the wire-drawing direction at the time of wire-drawing of a rod material or the like may also be conventionally described as RD. Thus, when the term RD is used in the present specification, this collectively refers to the rolling direction and the wire-drawing direction, and is intended to mean the working direction for a sheet material, a rod material (wire material), or the like.

<Composition of Cu—Al—Mn-Based Alloy>

The copper-based alloy of the present invention having shape memory characteristics and superelasticity is an alloy containing Al and Mn. This alloy becomes a β phase (body-centered cubic) single phase (in the present specification, which may be simply referred to as β single phase) at high temperature, and becomes a two-phase texture of a β phase and an α phase (face-centered cubic) (in the present specification, may be simply referred to as (α+β) phase) at low temperature. The temperatures ranges may vary depending on the alloy composition, but the high temperature at which the β single phase is obtained is usually 700° C. or higher, and the low temperature at which the (α+β) phase is obtained is usually less than 700° C.

The Cu—Al—Mn-based alloy material of the present invention has a composition containing 3.0 to 10.0 mass % of Al and 5.0 to 20.0 mass % of Mn, with the balance being Cu and unavoidable impurities. If the content of elemental Al is too small, the β single phase cannot be formed, and if the content is too large, the alloy material becomes brittle. The content of elemental Al may vary depending onto the content of elemental Mn, but a preferred content of elemental Al is 6.0 to 10.0 mass %. When the alloy material contains elemental Mn, the range of existence of the β phase extends to a lower Al-content side, and cold workability is markedly enhanced. Thus, forming work is made easier. If the amount of addition of elemental Mn is too small, satisfactory workability is not obtained, and the region of a β single phase cannot be formed. Also, if the amount of addition of elemental Mn is too large, sufficient shape recovery characteristics are not obtained. A preferred content of Mn is 8.0 to 12.0 mass %. The Cu—Al—Mn alloy material having the above-described composition has high hot workability and cold workability, and enables to obtain a working ratio of 20 to 90% or higher in cold-working. Thus, the alloy material can be worked by forming into rods (wires) and sheets (strips), as well as fine wires, foils, pipes and the like that have been conventionally difficult to work.

In addition to the essential alloying elements described above, the Cu—Al—Mn-based alloy material of the present invention can further contain, optional additionally alloying element(s), at least one selected from the group consisting of Ni, Co, Fe, Ti, V, Cr, Si, Nb, Mo, W, Sn, Mg, P, Be, Sb, Cd, As, Zr, Zn, B, C, Ag and misch metal (for example, Pr and Nd). These elements exhibit an effect of enhancing the physical strength of the Cu—Al—Mn-based alloy material, while maintaining cold workability. The content in total of these optional additionally elements is preferably 0.001 to 10.000 mass %, and particularly preferably 0.001 to 5.000 mass %. If the content of these optional additionally elements is too large, the martensite transformation temperature is lowered, and the β single phase texture becomes unstable.

Ni, Co, Fe and Sn are elements that are effective for strengthening of the matrix microstructure. Co makes the crystal grains coarse by forming Co—Al intermetallic compound, but Co in an excess amount causes lowering of toughness of the alloy. A content of Co is 0.001 to 2.000 mass %. A content of Ni and Fe is respectively 0.001 to 3.000 mass %. A content of Sn is 0.001 to 1.000 mass %.

Ti is bonded to N and O, which are inhibitory elements, and forms oxynitride. Also, Ti forms boride when added in combination with B, to enhance physical strength. A content of Ti is 0.001 to 2.000 mass %.

V, Nb, Mo and Zr have an effect of enhancing hardness, to enhance abrasion resistance. Further, since these elements are hardly solid-solubilized into the matrix, the elements precipitate as a β phase (bcc crystals), to enhance physical strength. Contents of V, Nb, Mo and Zr are respectively 0.001 to 1.000 mass %.

Cr is an element effective for retaining abrasion resistance and corrosion resistance. A content of Cr is 0.001 to 2.000 mass %. Si has an effect of enhancing corrosion resistance. A content of Si is 0.001 to 2.000 mass %. W is hardly solid-solubilized into the matrix, and thus has an effect of precipitation strengthening. A content of W is 0.001 to 1.000 mass %.

Mg has an effect of eliminating N and O, which are inhibitory elements, fixes S that is an inhibitory element as sulfide, and has an effect of enhancing hot workability or toughness. Addition of a large amount of Mg brings about crystal grain boundary segregation, and causes embrittlement. A content of Mg is 0.001 to 0.500 mass %.

P acts as a de-acidifying agent, and has an effect of enhancing toughness. A content of P is 0.01 to 0.50 mass %. Be, Sb, Cd, and As have an effect of strengthening the matrix microstructure. Contents of Be, Sb, Cd and As are respectively 0.001 to 1.000 mass %.

Zn has an effect of raising the shape memory treatment temperature. A content of Zn is 0.001 to 5.000 mass %. When appropriate amounts of B and C are used, a pinning effect is obtained, and thereby an effect of coarsening the crystal grains is obtained. Particularly, combined addition of B and C together with Ti and Zr is preferred. Contents of B and C are respectively 0.001 to 0.500 mass %.

Ag has an effect of enhancing cold workability. A content of Ag is 0.001 to 2.000 mass %. When an appropriate amount of misch metal is used, a pinning effect is obtained, and thereby an effect of coarsening the crystal grains is obtained. A content of misch metal is 0.001 to 5.000 mass %. Misch metal refers to an alloy of rare earth elements, such as La, Ce, and Nd, for which separation into simple substances is difficult.

<Metallic Microstructure of Cu—Al—Mn-Based Alloy Material>

The Cu—Al—Mn-based alloy material of the present invention has a recrystallized texture. Further, the Cu—Al—Mn-based alloy material of the present invention has a recrystallized texture that is substantially formed from (composed of) a β single phase. The expression 'having a recrystallized texture substantially formed from a β single phase' means that the proportion occupied by a β phase in the recrystallization texture is generally 90% or more, and preferably 95% or more.

In the technical field of the present invention, even if a large number of crystal grains exist randomly without being aligned a uniform crystalline orientation, if this is a so-called bamboo structure (as schematically shown in FIG. 1, a metallic texture having a crystal structure in which crystal grain boundaries are positioned like the nodes of a bamboo tree), the average strain of the amounts of transformation strains in various orientations may be obtained as superelasticity. In this case, consequently, the average strain may be obtained approximately to the same extent as the transformation strain in the predetermined texture defined in the present invention. For example, even in a situation in which only several crystal grains exist randomly, there are occasions in which a superelastic strain of close to 10% in the average is provided, and there were also occasions in which this superelastic strain was about 3%. Further, in the case where the control of small crystal grains is impossible, for example, there are occasions in which although the alloy material provides the superelastic strain described above after several times of repeated deformations, the alloy material may not function as a shape memory alloy after 100 times of repeated deformations.

Thus, controlling a Cu—Al—Mn-based alloy material to have a predetermined texture and a predetermined crystal grain size constitutes the technical significance of the present invention. That is, according to the present invention, when a predetermined texture is formed, the alloy material stably exhibits superelastic characteristics, and in addition to that, even if predetermined small crystal grains (crystal grains X) are co-present at a certain low existence ratio in the bamboo structure formed by predetermined large crystal grains (crystal grains Y or Z), exhibition of superelasticity capable of enduring a number (for example, 100 times) of repeated deformations has been made possible. As such, a remarkable effect can be obtained, which is unpredictable from the conventional means.

There also has been a demand for a bamboo structure in the conventional technologies, but only large crystal grains could be controlled, and the control of small crystal grains could not be achieved. Thus, alloy materials exhibited satisfactory superelasticity after several repeated cycles, but the quantity of residual strain increased after a large number of cycles. This is because residual strain is accumulated in the crystal grain boundaries. Small crystal grains that caused residual strain after a large number of repeated deformations were controlled to be eliminated up to a certain mixed use ratio, and thereby the residual strain after a large number of repetitions could be made small. As such, a remarkable effect can be obtained, which is unpredictable from the conventional means.

<Definitions of Crystal Grain Sizes and Controls Thereof>

In the Cu—Al—Mn-based copper alloy of the present invention, crystal grains having small crystal grain sizes (crystal grains X defined in the present invention) exist in an amount of existence (existence proportion) as low as 15% or less, but most of the crystal grains are crystal grains having large crystal grain sizes (for example, crystal grains Y and Z defined in the present invention, in which the crystal grain lengths satisfy the relationships of $a \geq b$). For example, in the case of a rod material, regarding a small crystal grain (this is referred to as crystal grain X) in which the crystal grain length ($a_x$ for the crystal grain X) in the working direction (RD) with respect to the sample diameter R is R/2 or less, and the crystal grain length ($b_x$ for the crystal grain X) in a direction perpendicular to the working direction (RD) is R/4 or less, the amount of existence of the crystal grains X is 15% or less, and preferably 10% or less, of the total amount of the alloy material. Further, in the case of a sheet material, regarding a small crystal grain (this is referred to as crystal grain X) in which the crystal grain length ($a_x$ for the crystal grain X) in the working direction with respect to the sample width R (direction perpendicular to the RD, that is, sample length in the TD) is R/2 or less, and the crystal grain length ($b_x$ for the crystal grain X) in a direction perpendicular to the working direction (RD) is R/4 or less, the amount of existence of the crystal grains X is 15% or less, and preferably 10% or less, of the total amount of the alloy material. Herein, the amount of existence of the crystal grains X can be determined based on the proportion of the area (area ratio) occupied by the relevant crystal grains at a surface or a cross-section of the Cu—Al—Mn-based copper alloy material. For the measurement, an area of a surface or a cross-section in the longitudinal direction of the alloy material, in which measurement has been arbitrarily made at 4 or more points, can be employed. In regard to the crystal grain X according to the present invention, evaluation shall be performed at the surface of the Cu—Al—Mn-based alloy material, where the working ratio is substantially higher than the working ratio at the central portion due to the influence of additional shear stress in the working process or the friction at a tool surface, and the crystal grains are likely to become fine.

The large crystal grains, crystal grain Y and crystal grain Z (or crystal grains Y' and Z' in the final state), are such that the crystal grain lengths thereof (a and b) satisfy the relationships of a≥b. In regard to the crystal grain Y and the crystal grain Z (or crystal grains Y' and Z' in the final state), it is particularly preferable that the crystal grain lengths (a and b, or a' and b' in the final state) satisfy the relationships of a 1.5b (or a'≥1.5b' in the final state). In the Cu—Al—Mn-based alloy material of the present invention, the superelastic characteristics for repeated deformations can be further enhanced by achieving a balance between the state of the crystal grain sizes and preferably the texture that will be explained below.

Regarding this large crystal grain, with regard to the crystal grain Y (or crystal grain Y' in the final state) in which the crystal grain length a in the working direction and the crystal grain length b in a direction perpendicular to the working direction satisfy the relationships of a≥b, and the angle formed by the normal line of the (111) plane of the crystal and the working direction (RD) is 15° or larger, the amount of existence of the crystal grain Y (or crystal grain Y' in the final state) is 85% or more of the total amount of the alloy material. It is preferable that the amount of existence of the crystal grain Y is 90% or more.

Further, among crystal grains Y as described above, with regard to the crystal grain Z (or crystal grain Z' in the final state) in which the angle formed by the normal line of the (101) plane of the crystal and the working direction (RD) is 20° or less, it is preferable that the amount of existence of the crystal grain Z is 50% or more of the total amount of the alloy material. It is more preferable that the amount of existence of the crystal grain Z (or crystal grain Z' in the final state) is 60% or more.

In the case where the sum total of the amount of existence of crystal grains X and the amount of crystal grains Y (crystal grains Y include crystal grains Z) is less than 100%, this means that crystal grains having a size other than the sizes of the crystal grains X and the crystal grains Y exist, in addition to the crystal grains X and the crystal grains Y. In this case, the size of the crystal grains having a size other than the sizes of the crystal grains X and the crystal grains Y is larger than that of the crystal grains X and smaller than that of the crystal grains Y.

<Definitions of Texture and Controls Thereof>

Figure 2A:
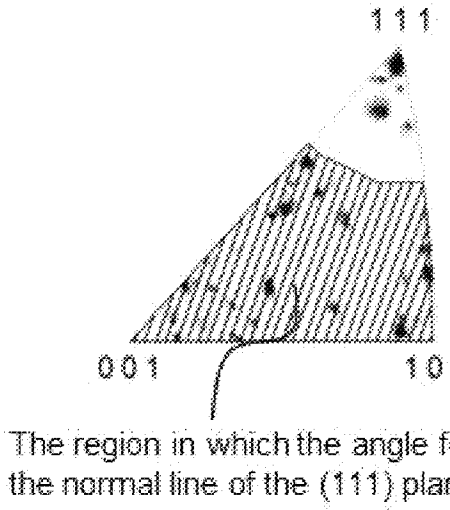
FIG. 2(*a*) and FIG. 2(*b*) each is a schematic diagram explaining the texture defined in the present invention. The marked portion in the inverse pole figure of FIG. 2(*a*) is a region in which the angle formed by the normal line of the (111) plane of the crystal and the working direction is 15° or more. A crystal, which is within this region and has crystal grain lengths that satisfy the relationships of a≥b, is crystal grain Y' (or crystal grain Yin the state of the mid course).
Figure 2B:
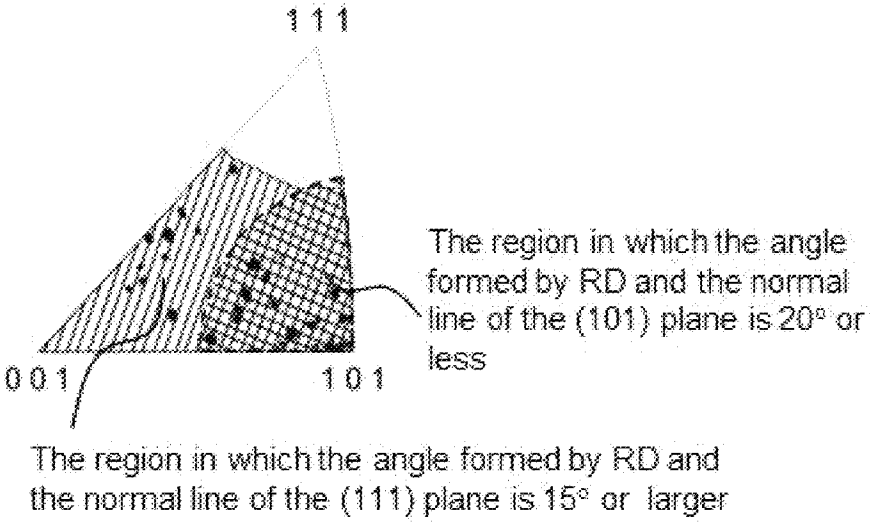

In regard to the Cu—Al—Mn-based alloy material of the present invention, in the case where the crystalline orientation of a sample is analyzed at a plane that faces the stress axis direction (working direction, RD) by electron backscatter diffraction pattern analysis (EBSP) (taking the area of the alloy material in which measurement has been made arbitrarily at three or more points (magnification of 100×)), 85% or more, and preferably 90% or more, of the crystal grains have a texture in which the angle formed by the normal line of the (111) plane and the working direction is 15° or larger (see FIG. 2(*a*) of Comparative Example 1 or FIG. 2(*b*) of Example 1). In other words, the proportion of crystal grains in which the angle formed by the normal line of the (111) plane of the crystal and the working direction is 15° or larger, is 85% or more, and preferably 90% or more, of all the crystal grains. The crystal grains in which the angle formed by the normal line of the (111) plane and the working direction is 15° or larger, may exist in an area ratio (amount of existence) of 100% with respect to all the crystal grains of the observation plane, but in reality, the area proportion may be less than 100%. In the present invention, a crystal grain in which the crystal grain lengths satisfy the relationships of a≥b, and in which the angle formed by the normal line of the (111) plane of the crystal and the working direction is 15° or larger, is referred to as crystal grain Y. The direction of the normal line of the (111) plane is the direction of the (111) plane. Similarly, the direction of the normal line of the (101) plane is the direction of the (101) plane.

More preferably, the Cu—Al—Mn-based alloy material of the present invention has a texture in which, among the crystal grains Y, in addition to the crystal grain lengths and the texture described above, preferably 50% or more of the crystal grains, and more preferably 60% or more of the crystal grains, are such that the angle formed by the normal line of the (101) plane of the crystal and the working direction (RD) is within the range of 20°. In other words, among the crystal grains Y, the proportion of the crystal grains in which the angle formed by the normal line of the (101) plane of the crystal and the working direction (RD) is 20° or less, is preferably 50% or more, and more preferably 60% or more, of all the crystal grains. In the present invention, such a crystal grain is referred to as crystal grain Z.

In the present invention, the degree of integration in directions other than the <111> direction or the degree of integration in the <101> direction are measured by a SEM-EBSD method. The specific measurement method will be explained below.

The Cu—Al—Mn-based alloy material of the present invention is cut such that the plane facing the stress axis direction (working direction, RD) becomes an observation plane, and the alloy material is embedded in an electroconductive resin and is subjected to vibration-type buff finish (polishing). Measurement is made by an EBSD method at four or more sites in a measurement region of about 800 μm×2,000 μm, under the conditions of a scan step of 5 μm. Herein, regarding the specimen for measuring the recrystallized texture, a specimen extracted at the time point of completion of [Step 5-4] is used. This is because if the Cu—Al—Mn-based alloy material of the present invention is subjected to the entire shape memory heat treatment including the final step [Step 5-10], since crystal grains grow coarsely, it becomes difficult to analyze the texture. Thus, when a specimen is extracted at the time point of completion of [Step 5-4], which is a step of the mid course, the distribution of the crystalline orientation before coarsening of the crystal grains can be checked, and thus, the specimen is inspected in the state described above. For the analysis, the crystalline orientation obtained from all of the analysis results using an OIM software program (trade name, manufactured by TSL) is plotted on an inverse pole figure (see, for example, FIG. 2(*a*) and FIG. 2(*b*)). As described above, the area of the atomic plane of a crystal grain in which the angle formed by the normal line of the (111) plane and the working direction is within the range of 15° or larger, and the area of the atomic plane of a crystal grain in which the angle formed by the normal line of the (101) plane and the working direction is within the range of 20° or less, are respectively determined. The respective areas thus obtained are divided by the total analytic area, and thereby the amount of existence of crystal grains in which the angle formed by the normal line of the (111) plane and the working direction is 15° or larger and the amount of existence of crystal grains in which the angle formed by the normal line of the (101) plane and the working direction is within 20° are obtained. Among these, the amount of existence of crystal grains of [Step 5-4] having a predetermined orientation, which correspond to crystal grains in which the crystal grain lengths of the material obtainable after a final heat treatment satisfy the relationships of a≥b, is the amount of existence of the crystal grains Y and the crystal grains Z, and the amount of existence of the crystal grains at the time point of completion of [Step 5-10] is the amount of existence of the crystal grains Y' and the crystal grains Z'.

With the methods for working and heat treatment according to the present invention, the crystal grain size in the final steps of a shape memory heat treatment can be controlled, without destroying the proportions of the controlled crystalline orientations. Thus, the range of the orientation property of the crystalline orientation according to the present invention is equal to that of the orientation property of the final crystalline orientation.

For example, in Example 1 indicated in Table 3-2, the results obtained by analyzing a specimen extracted at the time point of completing [Step 5-4] at four points in an analytic region having a size of about 800 μm×2,000 μm by the SEM-EBSD method are recorded, as the values of the amounts of existence of the crystal grains Y and the crystal grains Z. Thus, it is shown that the amount of crystal grains Y (proportion of area ratio) in which the angle formed by the normal line of the (111) plane and the working direction was 15° or larger, was 88%, and that, among the crystal grains Y, the amount of crystal grains Z in which the angle formed by the normal line of the (101) plane of the crystal and the working direction was 20° or less, was 60%. That is, in those cases, the magnitude of the crystal grain size is not considered.

On the other hand, regarding the working conditions and the like, for a material that had been produced in the same manner as in Example 1 and subjected up to [Step 5-10], an arbitrary crystal grain was measured by the SEM-EBSD method, the orientation property of the crystalline orientation of the crystal grain was clarified, and then the crystal grain lengths of the crystal grain and the area ratios were determined by calculation. As a result, the amount of crystal grains (hereinafter, crystal grains Y') in which the angle formed by the normal line of the (111) plane and the working direction was 15° or larger was 89%, and the amount of crystal grains (hereinafter, crystal grains Z') in which the angle formed by the normal line of the (101) plane and the working direction was 20° or less was 65%. For the crystal grains Y' and the crystal grains Z', the crystalline orientations were checked by the SEM-EBSD method, then images of the crystal grain size were taken using a digital camera or the like, and thereby the area (area ratio) is calculated.

When the amounts of existence of the crystalline orientations of the crystal grains at the time points of [Step 5-4] and [Step 5-10] were compared, using the analytic method such as described above. In Example 26, while crystal grains Y 91% and crystal grains Z 60% were obtained at the time point of [Step 5-4] (the state in the mid course of the production), crystal grains Y' 95% and crystal grains Z' 68% were obtained at the time point of [Step 5-10] (the final state); in Example 27, while crystal grains Y 88% and crystal grains Z 55% were obtained at the time point of [Step 5-4], crystal grains Y' 88% and crystal grains Z' 60% were obtained at the time point of [Step 5-10]; and in Example 39, while crystal grains Y 85% and crystal grains Z 54% were obtained at the time point of [Step 5-4], crystal grains Y' 85% and crystal grains Z' 55% were obtained at the time point of [Step 5-10]. Thus, it was confirmed that crystal grains grew almost without any change in the orientation property of the crystalline orientation, and crystal grains were coarsened. This indicates that in the heat treatment steps according to the present invention, generation of new nuclei is not induced by a heat treatment, and crystal grains are coarsened. In addition to the fact that there are limitations on the size of the specimen in the SEM-EBSD method, and that the textures in the mid course can be easily checked, consistency with the final crystalline orientation is confirmed as described above. Thus, the amounts of existence of crystal grains Y and crystal grains Z, which are the textures in the mid course, can be regarded and handled as the amounts of existence of crystal grains Y' and crystal grains Z' of the final texture. Accordingly, it can be said that the amount of existence (proportion) of the crystal grains according to the present invention that exhibit a predetermined orientation as checked in the mid course of the production process represents an amount of existence equivalent to that of the final texture state.

In the case where the crystalline orientation of each crystal grain after performing the final heat treatment is measured by the SEM-EBSD method, the measurement region includes crystal grains X, and the area ratio is checked by measuring the crystalline orientations of at least 20 or more at the minimum of crystal grains including crystal grains Y and Z (or crystal grains Y' and Z') other than the crystal grains X. In regard to the evaluation of the area ratio in the final state, since crystal grains have been coarsened, the EBSD method is not performed, and the area ratio is calculated from a photograph or the like. That is, in Step [5-4], measurement of the crystalline orientation and the area ratio is performed by the EBSD method, but in [Step 5-10], only the crystalline orientation is measured by the EBSD method, and measurement of the area ratio is performed using a photograph or the like. Herein, for the confirmation of the texture after the final heat treatment of [Step 5-10], measurement of the crystalline orientation and the crystal grain size of the same material at a different position in the longitudinal direction was performed, and similar results were acknowledged.

Further, since the crystal grains X of the material after the final heat treatment had a small crystal grain size, the crystalline orientation was not evaluated, and an evaluation of the crystal grain size and the area ratio only was performed. The measurement range for the area ratio of the crystal grain size related to the crystal grains X is defined as a range including 20 or more at the minimum of crystal grains, similarly to the range in which the crystal grains Y' and the crystal grains Z' are identified.

The method of measuring the crystal grain size and the method of measuring the crystalline orientation, each according to the present invention, are performed respectively and independently.

<Method of Producing Cu—Al—Mn-Based Alloy Material>

Figure 3:
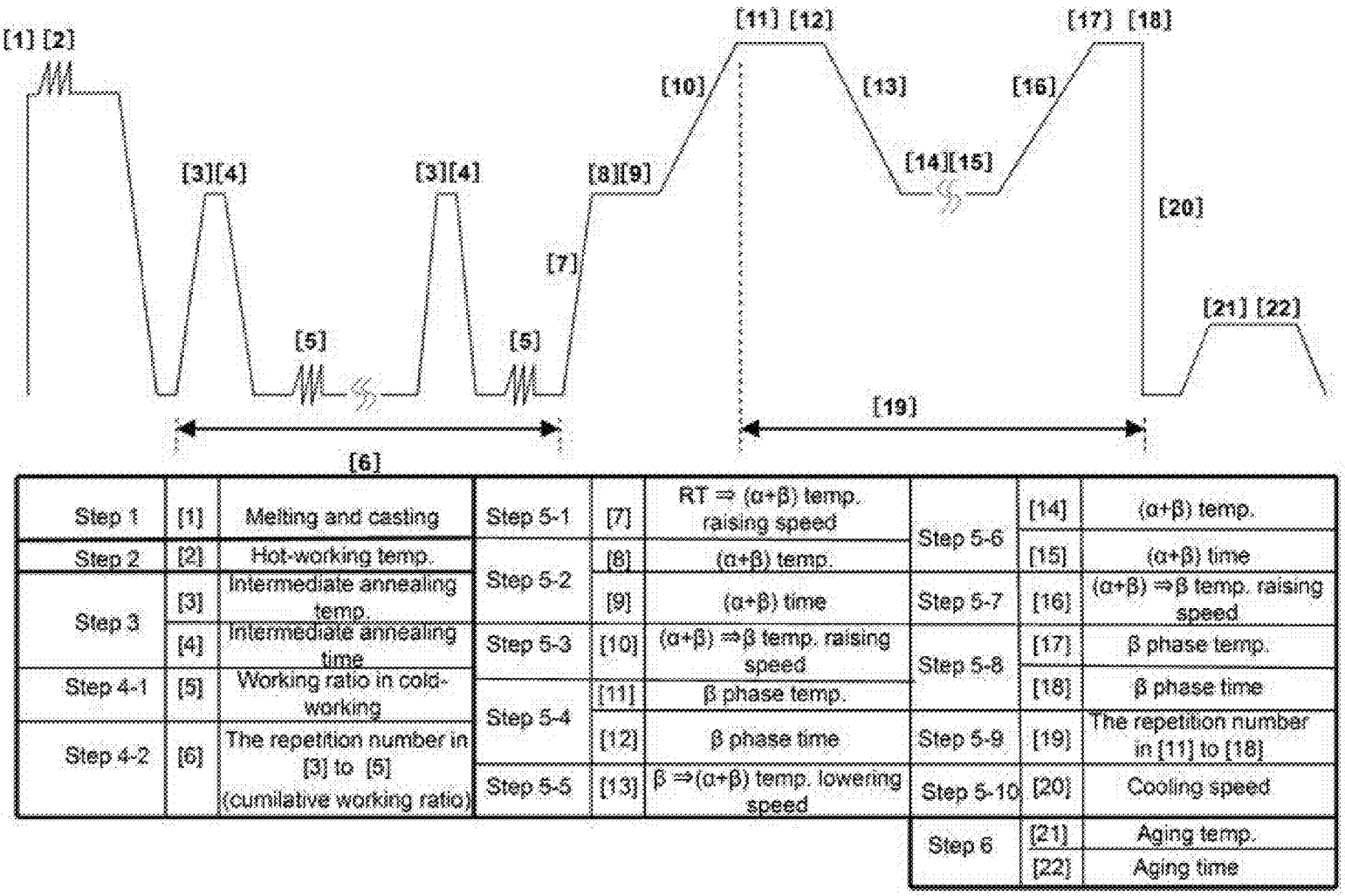
FIG. 3 is a flow chart illustrating the entire process of the production method of the present invention. The names of the steps are shown together with the flow chart.
Figure 5A:
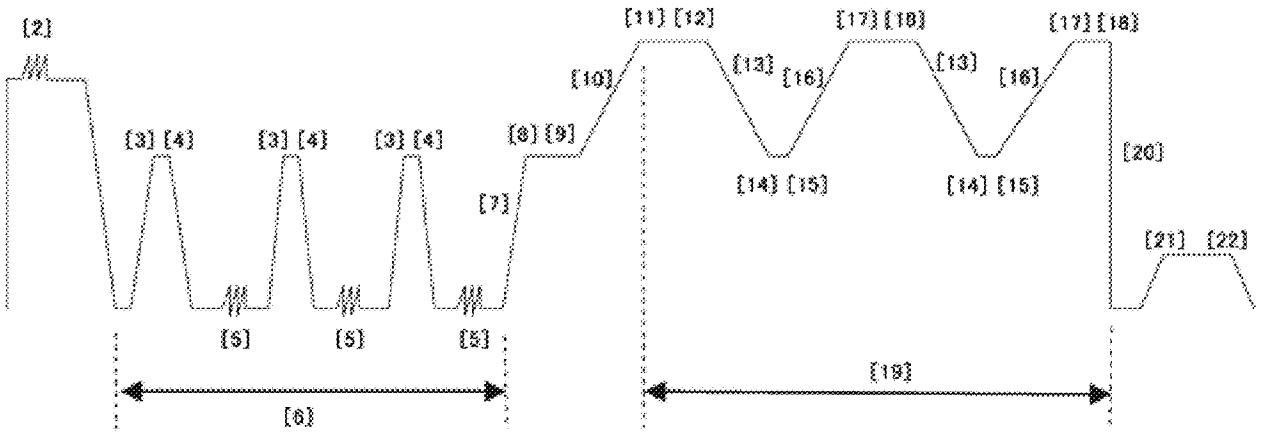
FIG. 5(*a*) is a flow chart illustrating the production process of Example 1 (produced in Process No. a as will be described below), FIG. 5(*b*) is a flow chart illustrating the production process of Comparative Example 1 (produced in Process No. A as will be described below). The conditions for working and heat treatments, and the number of repetitions for the steps are shown together. Example 1 and Comparative Example 1 are different from the viewpoint that in Example 1 (Process No. a), the number of repetitions [19] of slow temperature lowering [Step 5-5] [13] and slow temperature raising [Step 5-7] [16] in the shape memory heat treatment is two times; whereas in Comparative Example 1 (Process No. A), slow temperature lowering [Step 5-5] [13] and slow temperature raising [Step 5-7] [16] in this shape memory heat treatment were performed only once, that is, the number of repetitions [19] is one time.
Figure 5B:
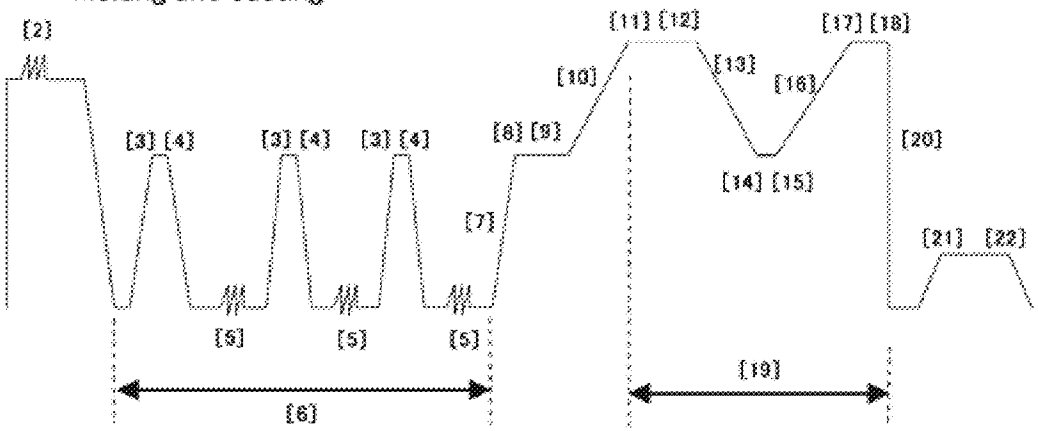

In regard to the Cu—Al—Mn-based alloy material of the present invention, regarding the production conditions for obtaining a superelastic alloy material which stably provides satisfactory superelastic characteristics and has excellent resistance to repeated deformations, a production process such as described below may be mentioned. A representative example of the production process is illustrated in FIG. 3. Further, a preferred example of the production process is illustrated in FIG. 5(*a*).

In the following explanation, the treatment temperature and treatment time (retention time) for a heat treatment, and the working ratio (cumulative working ratio) of cold-working, all being described with the terms "(for example,)" are representatively indicated with the values used in Process No. a in Example 1, and the present invention is not intended to be limited to these values.

In the entire production process, particularly, when the heat treatment temperature [3] for intermediate annealing [Step 3] is set to the range of 400° C. to 680° C., and the cold-working ratio or the working ratio for cold wire-drawing [5] for the cold work (specifically, cold rolling or cold wire-drawing) [Step 4-1] is set to the range of 30% or more, a Cu—Al—Mn-based alloy material which stably provide satisfactory superelastic characteristics is obtained. In addition to those, in the shape memory heat treatment [Step 5-1] to [Step 5-10], the speeds of temperature raising [10] and [16] in heating [Step 5-3] and [Step 5-7] from the temperature ranges [8] and [14] for obtaining the (α+β) phase (which may vary depending on the alloy composition, but usually near 300° C. to 700° C., and preferably 400° C. to 650° C.) to the temperature ranges [11] and [17] for obtaining the β single phase (which may vary depending on the alloy composition, but usually 700° C. or higher, preferably 750° C. or higher, and more preferably 900° C. to 950° C.), and the speed of temperature lowering [13] in cooling [Step 5-5] from the temperature range [11] for obtaining the β single phase to the temperature range [14] for obtaining the (α+β) phase, are all controlled to a predetermined slow range such as 0.1° C./min to 20° C./min. Further, after the heating [Step 5-3] from the temperature range [8] for obtaining the (α+β) phase to the temperature range [11] for obtaining the β single phase, a series of steps including: from retention [Step 5-4] in a temperature range [11] for obtaining the β single phase for a predetermined time [12]; cooling [Step 5-5] from the temperature range [11] for obtaining the β single phase to the temperature range [14] for obtaining the (α+β) phase at a speed of temperature lowering [13] of 0.1° C./min to 20° C./min, retention [Step 5-6] in the temperature range [14] fora predetermined time [15]; heating [Step 5-7] from the temperature range [14] for obtaining the (α+β) phase to the temperature range [17] for obtaining the β single phase at a speed of temperature raising [16] of 0.1° C./min to 20° C./min, to retention [Step 5-8] in the temperature range [17] for a predetermined time [18], that is, a series including from [Step 5-4] to [Step 5-8], is repeated at least two times (Step [5-9]). Thereafter, rapid cooling [Step 5-10] is carried out lastly.

Further, before the [Step 5-9] of repeating at least two times from [Step 5-4] to Step [5-8] including these temperature lowering [Step 5-5] and temperature raising [Step 5-7], it is preferable to perform heating [Step 5-1] to the temperature range [8] for obtaining the (α+β) phase at a speed of temperature raising [7], and then retention [Step 5-2] in this temperature range [8] for a certain retention time [9]. As such, once retention [Step 5-2] in the temperature range [8] for obtaining the (α+β) phase is performed and then temperature raising [Step 5-3] to the temperature range [11] for obtaining the β single phase is performed, the amount of precipitation of the α phase or the size is maintained constant and small. Thus, in the case where a crystal grain coarsening treatment is performed by rapid cooling [Step 5-10] at the end of the shape memory heat treatment, an effect of having enlarged crystal grains may be readily obtained.

Thus, first, when temperature raising [Step 5-1] to the temperature range [8] for obtaining the (α+β) phase is performed, and then the alloy material is subjected to retention [Step 5-2] in this temperature range [8] for obtaining the (α+β) phase (for example, 500° C.) for 2 to 120 minutes [9]. In regard to the alloy material is heated by the heat treatment [Step 5-1] described above, it is desirable if the material reaches the temperature range [8] for obtaining the (α+β) phase by temperature raising. Thus, there are no particular limitations on the speed of temperature raising [7] to this [Step 5-1], and it is not necessary to perform slow temperature raising in the present invention. This speed of temperature raising [7] can be set to, for example, 30° C./min, but the speed of temperature raising may be faster, or on the contrary, may be slower. In regard to the retention [Step 5-2], the retention time [9] in the temperature range [8] for obtaining the (α+β) phase is preferably 10 to 120 minutes. Further, fixing of the amount of precipitation of the α phase is implemented by [Step 5-2]. Since the amount of precipitation of the α phase can be controlled by [Step 5-2], there is no problem even if the speed of temperature raising of [Step 5-1] is not defined. For this reason, the speed of temperature raising of [Step 5-1] can be carried out at a faster speed, and the overall time taken for the production can be shortened. This is one of the advantages for the production method of the present invention.

Thereafter, temperature raising [Step 5-3] from the temperature range [8] for obtaining the (α+β) phase (for example, 500° C.) to the temperature range [11] for obtaining the β single phase (for example, 900° C.) at the speed of temperature raising [10] is performed, and the alloy material is retained [Step 5-4] in this temperature range [11] for a predetermined time [12]. Then, temperature lowering [Step 5-5] to the temperature range [14] for obtaining the (α+β) phase at the speed of temperature lowering [13] is performed, the alloy material is retained [Step 5-6] in this temperature range [14] for a predetermined time [15], and temperature raising (in the temperature raising [Step 5-7] after the second temperature raising, speed of temperature raising [16]) is performed again as described above. Steps including from this [Step 5-4] to [Step 5-8] is repeated [Step 5-9] two or more times [20] in total. Thereafter, rapid cooling [Step 5-10] is performed at the end, and the alloy material is subjected to a solution treatment. It is preferable to perform such an overall process.

Herein, along with slowing of the speeds of temperature raising [10] and [16] and the speed of temperature lowering [13] for the shape memory heat treatment (in the present specification, this is referred to as slow temperature raising and slow temperature lowering, respectively), when the temperature lowering [Step 5-5] and temperature raising [Step 5-7] are repeated two or more times, desired satisfactory superelasticity can be obtained even after repeated deformations. The speeds of temperature raising [10] and [16] and the speed of temperature lowering [13] are all 0.1° C./min to 20° C./min, preferably 0.1° C./min to 10° C./min, and more preferably 0.1° C./min to 3.3° C./min. Further, in regard to the shape memory heat treatment, after the last heating treatment in the slow temperature lowering [Step 5-5] and slow temperature raising [Step 5-7] (in the depicted example, [Step 5-7] and [16] on the rightmost side in the diagram) that are repeated at least two or more times, the alloy material is subjected to a solution treatment by rapid cooling [Step 5-10] (so-called quenching). This rapid cooling can be carried out by, for example, water cooling by introducing a Cu—Al—Mn-based alloy material that has been subjected to a shape memory heat treatment up to retention and heating to the β single phase [Step 5-8], into cooling water.

Preferably, a production process such as follows may be mentioned.

In a usual manner, after melting and casting [Step 1] and hot-working [Step 2] of hot rolling or hot forging is carried out, intermediate annealing [Step 3] at 400° C. to 680° C. [3] for 1 to 120 minutes [4], and then cold-working [Step 4-1] of cold rolling or cold wire-drawing at a working ratio of 30% or higher [5] are carried out. Herein, the intermediate annealing [Step 3] and the cold-working [Step 4-1] may be carried out once each in this order, or may be repeated [Step 4-2] in this order at a number of repetitions [6] of two or more times. Thereafter, the shape memory heat treatment [Step 5-1] to [Step 5-10] is carried out.

The shape memory heat treatment [Step 5-1] to [Step 5-10] includes: heating [Step 5-3] from a temperature range [8] for obtaining an (α+β) phase (for example, 500° C.) to a temperature range [11] for obtaining a β single phase (for example, 900° C.) at a speed of temperature raising [10] of 0.1° C./min to 20° C./min, preferably 0.1° C./min to 10° C./min, and more preferably 0.1° C./min to 3.3° C./min, retention [Step 5-4] at that heating temperature [11] for 5 minutes to 480 minutes, and preferably 10 to 360 minutes [12]; cooling [Step 5-5] from a temperature range [11] for obtaining a β single phase (for example, 900° C.) to a temperature range [14] for obtaining an (α+β) phase (for example, 500° C.) [14] at a speed of temperature lowering [13] of 0.1° C./min to 20° C./min, preferably 0.1° C./min to 10° C./min, and more preferably 0.1° C./min to 3.3° C./min; and retention [Step 5-6] at that temperature [14] for 20 to 480 minutes, and preferably 30 to 360 minutes [15]. Thereafter, the alloy material is subjected to: the heating [Step 5-7] again from a temperature range [14] for obtaining an (α+β) phase (for example, 500° C.) to a temperature range [17] for obtaining a β single phase (for example, 900° C.) at the speed of temperature raising [16] of the slow temperature raising; and retention [Step 5-8] at that temperature [17] for 5 minutes to 480 minutes, and preferably 10 to 360 minutes [18]. Repetition [Step 5-9] of such slow temperature lowering [13] [Step 5-5] and slow temperature raising [16] [Step 5-7] is carried out at a number of repetitions [19] of at least two times. Then, the shape memory heat treatment includes: rapid cooling [Step 5-10], for example, water cooling.

The temperature range for obtaining an (α+β) single phase is set to 300° C. to below 700° C., and preferably 400° C. to 650° C.

The temperature range for obtaining a β single phase is set to 700° C. or higher, preferably 750° C. or higher, and more preferably 900° C. to 950° C.

After the shape memory heat treatment [Step 5-1] to [Step 5-10], it is preferable to perform an aging heat treatment [Step 6] at below 300° C. [21] for 5 to 120 minutes [22]. If the aging temperature [21] is too low, the β phase is unstable, and if the alloy material is left to stand at room temperature, the martensite transformation temperature may change. On the contrary, if the aging temperature [21] is too high, precipitation of the α phase occurs, and the shape memory characteristics or superelasticity tends to be decreased conspicuously.

By repeatedly performing [Step 4-2] intermediate annealing [Step 3] and cold-working [Step 4-1], the crystalline orientation can be integrated more preferably. The number of repetitions [6] of intermediate annealing [Step 3] and cold-working [Step 4-1] may be one time, but is preferably two or more times, and more preferably three or more times. This is because, as the number of repetitions [6] of the intermediate annealing [Step 3] and the cold-working [Step 4-1] is larger, the degree of integration facing the <101> direction increases, to enhance the characteristics.

(Preferred Conditions for the Steps)

The intermediate annealing [Step 3] is carried out at 400° C. 680° C. [3] for 1 minute to 120 minutes [4]. It is preferable that this intermediate annealing temperature [3] is set to a lower temperature, and preferably to 400° C. to 550° C.

The cold-working [Step 4-1] is carried out at a working ratio [5] of 30% or higher. Herein, the working ratio is a value defined by formula:

$$\text{Working ratio (\%)}=\{(A_1-A_2)/A_1\}\times 100$$

wherein $A_1$ represents the cross-sectional area of a specimen obtained before cold-working (cold-rolling or cold-wire-drawing); and $A_2$ represents the cross-sectional area of the specimen obtained after cold-working.

The cumulative working ratio ([6]) in the case of repeatedly performing this intermediate annealing [Step 3] and cold-working [Step 4-1] two or more times is preferably set to 30% or higher, and more preferably 45% or higher. There are no particular limitations on the upper limit of the cumulative working ratio, but the cumulative working ratio is usually 95% or lower.

In regard to the shape memory heat treatment [Step 5-1] to [Step 5-10], first, in [Step 5-1], temperature raising is carried out after the cold-working, from room temperature to a temperature range [8] for obtaining an (α+β) phase (for example, 500° C.) at the speed of temperature raising [7] (for example, 30° C./min). Then, retention [Step 5-2] is performed in a temperature range [8] for obtaining an (α+β) phase (for example, 500° C.) for 2 to 120 minutes, and preferably 10 to 120 minutes [9]. Then, when heating [Step 5-3] is performed from a temperature range [8] for obtaining an (α+β) phase (for example, 500° C.) to a temperature range [11] for obtaining a β single phase (for example, 900° C.), the speed of temperature raising [10] is set to 0.1° C./min to 20° C./min, preferably 0.1° C./min to 10° C./min, and more preferably 0.1° C./min to 3.3° C./min, of the slow temperature raising. Then, the alloy material is retained [Step 5-4] in this temperature range [11] for 5 to 480 minutes, and preferably 10 to 360 minutes [12]. Then, cooling [Step 5-5] is performed from a temperature range [11] for obtaining a β single phase (for example, 900° C.) to a temperature range [14] for obtaining an (α+β) phase (for example, 500° C.) at a speed of temperature lowering [13] of 0.1° C./min to 20° C./min, preferably 0.1° C./min to 10° C./min, and more preferably 0.1° C./min to 3.3° C./min, and the alloy material is retained [Step 5-6] in this temperature range [14] for 20 to 480 minutes, and preferably 30 to 360 minutes [15]. Then, heating [Step 5-7] is performed again from a temperature range [14] for obtaining an (α+β) phase (for example, 500° C.) to a temperature range [17] for obtaining a β single phase (for example, 900° C.) at the speed of temperature raising [16] of the slow temperature raising, and the alloy material is retained [Step 5-8] in this temperature range [17] for 5 to 480 minutes, and preferably 10 to 360 minutes [18]. Repetition [Step 5-9] of such a [Step 5-4] to [Step 5-8] (conditions [11] to [18]) is carried out at least two times [19].

The cooling speed [20] at the time of rapid cooling [Step 5-10] is usually set to 30° C./sec or more, preferably 100° C./sec or more, and more preferably 1,000° C./sec or more.

The final optional aging heat treatment [Step 6] is usually carried out at 70° C. to 300° C. [21] for 5 to 120 minutes [22], and preferably at 80° C. to 250° C. [21] for 5 to 120 minutes [22].

<Physical Property>

The superelastic Cu—Al—Mn-based alloy material of the present invention has the following physical properties (characteristics).

Figure 4A:
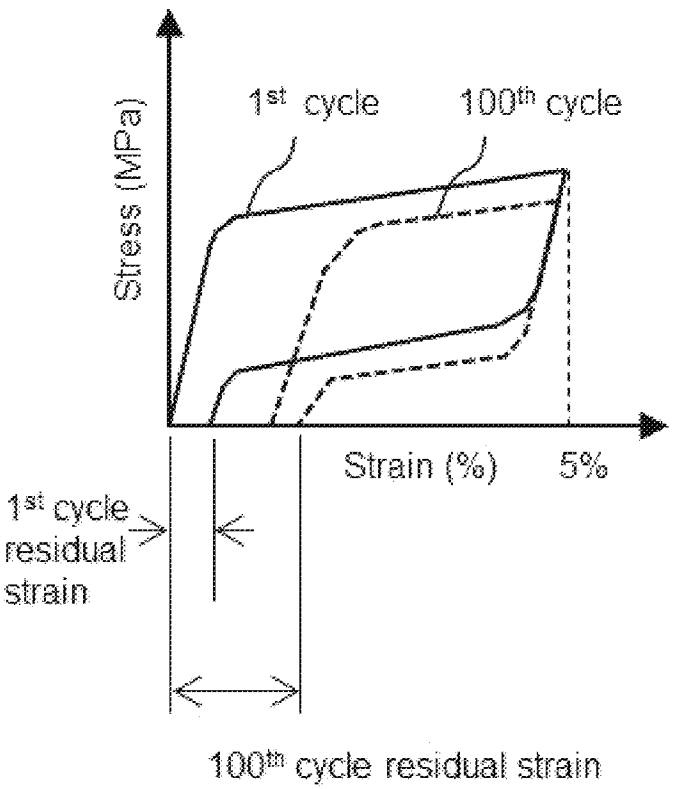
FIG. 4(*a*) and FIG. 4(*b*) each is a schematic diagram explaining the definitions of the physical property values provided by the Cu—Al—Mn-based alloy material of the present invention.
Figure 4B:
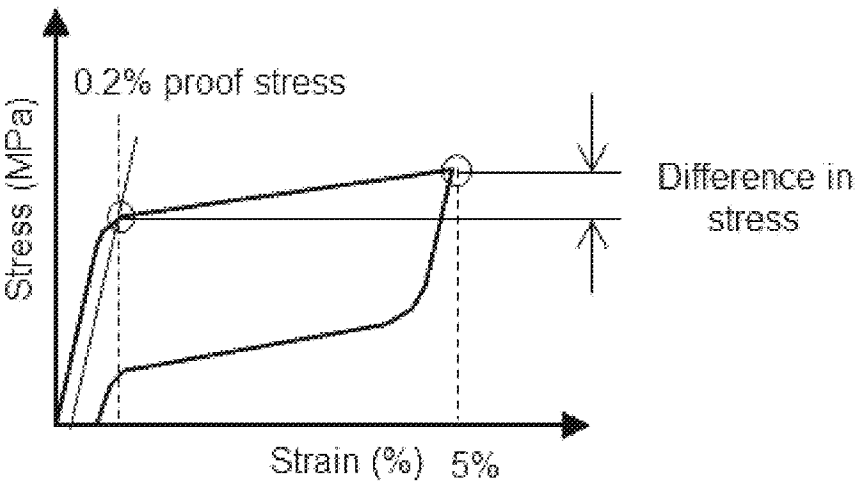
Figure 6A:
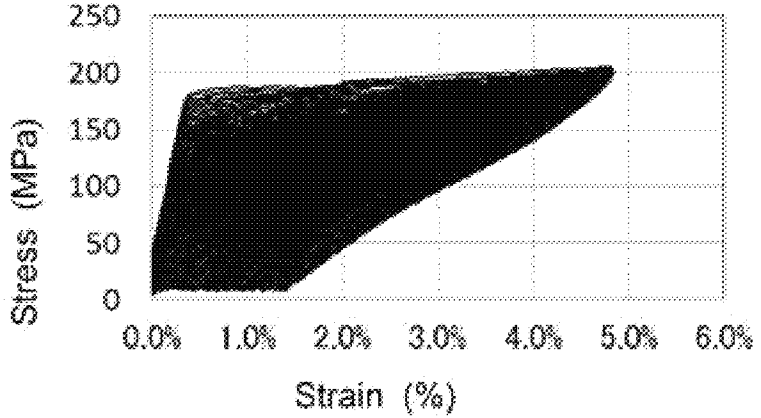
FIG. 6(*a*) is an S-S curve obtained by analyzing the sample obtained from Example 1 (Process No. a), and FIG. 6(*b*) is an S-S curve for the sample obtained in Comparative Example 1 (Process No. A).
Figure 6B:
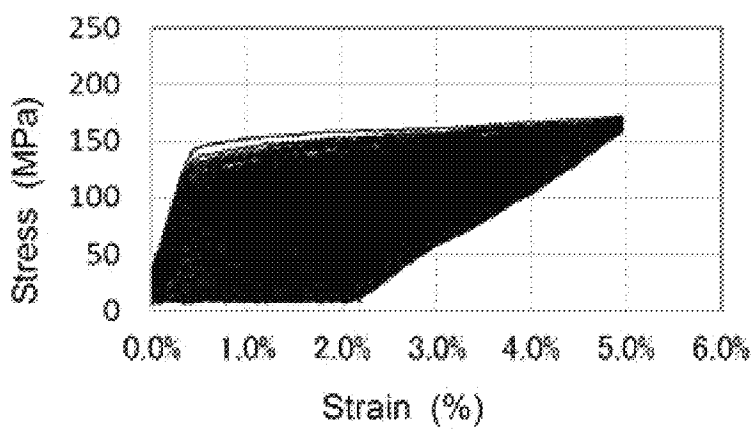

In regard to the Cu—Al—Mn-based alloy material of the present invention, the amount of residual strain in repeated deformations of repeating 100 times loading and unloading of a stress equivalent to an amount of strain of 5% (see, for example, FIG. 4(*a*) and FIG. 6(*a*)) is 2% or less. This amount of residual strain is preferably 1.5% or less. There are no particular limitations on the lower limit of this amount of residual strain, but the amount of residual strain is usually 0.1% or more.

Further, in the case where the difference between the stress value of the 0.2% proof stress value and the stress value exhibited when a strain of 5% is loaded is defined as the difference of stress (see, for example, FIG. 4(*b*) and FIG. 6(*a*)), the different of stress is preferably 50 MPa or less. This difference of stress is more preferably 30 MPa or less. There are no particular limitations on the lower limit of this difference of stress, but the difference of stress is usually 0.1 MPa or more. This difference of stress represents the amount of change in a region (a plateau region) where the stress exhibits an almost constant value with respect to an increase in strain in the stress-strain curve of a shape memory alloy. When this difference of stress is made small in a predetermined range, even in the case where the alloy material is subjected to a large force, only a certain quantity of force is transferred considering the strain. Thus, for example, when the alloy material is used as a construction material, the influence on the construction structure can be reduced. Further, if this difference of stress is small, since transformation and reverse transformation between the matrix phase and the martensite phase can occur easily, the alloy material can endure repeated deformations or vibrations.

<Size and Shape of Superelastic Cu—Al—Mn-Based Alloy Material>

The Cu—Al—Mn-based alloy material of the present invention is a shaped body that is elongated in the working direction (RD). As described previously, the working direction (RD) is the rolling direction for rolling if the alloy material is a sheet material, and is the wire-drawing direction for wire-drawing if the alloy material is a rod material. The alloy material of the present invention is elongated in the working direction (RD), but it is not necessarily essential that the longitudinal direction of the alloy material is consistent with the working direction. In the case where the Cu—Al—Mn-based alloy material of the present invention, which is a lengthy object, has been cut or bent, whether the alloy material is included in the present invention or not is determined, by considering which direction the original working direction of the alloy material is directed to. There are also no particular limitations on the specific shape of the Cu—Al—Mn-based alloy material of the present invention, and, for example, any shape of rod (wire), sheet (strip), and the like may be taken. There are also no particular limitations on the sizes of the Cu—Al—Mn-based alloy material of the present invention. For example, in the case of the rod, the diameter thereof may be employed 0.1 mm to 50 mm; or alternatively, the diameter of the rod may be the size of 8 mm to 16 mm depending on the use thereof. Further, the sheet may also have the thickness of 1 mm or more, for example, 1 mm to 15 mm. Herein, in regard to the production method of the present invention described above, a sheet material (a strip material) can be obtained by performing rolling instead of wire-drawing.

In the present invention, a rod material (or a wire material) may be any shape of a square rod (or a square wire) or a rectangular rod (or a rectangular wire), in addition to a round rod (or a round wire). In order to obtain the square rod (or the square wire), the round rod (or the round wire) obtained as above is subjected to, in a usual manner, for example, cold-working using a working machine, cold-working using a cassette roller die, pressing, drawing, and the like, to carry out a rectangular wire-working. Further, when a cross-section shape obtainable in rectangular wire-drawing is appropriately adjusted, a square rod (or a square wire) having a square cross-sectional shape and a rectangular rod (or a rectangular wire) having a rectangular cross-sectional shape can be produced individually. Further, the rod material (or the wire material) of the present invention may also have a tubular shape, which is a hollow shape having a tube wall, or the like.

<Vibration Damping Material or Construction Material>

The Cu—Al—Mn-based alloy material of the present invention can be preferably used as a vibration damping material or a construction material. This vibration damping material or construction material is constructed from the rod material or sheet material described above. Examples of the vibration damping material or construction material are not particularly limited, but, for example, may include brace, fastener, anchor bolt, and the like.

<Vibration Damping Structure>

The vibration damping structure of the present invention is preferably constructed of the Cu—Al—Mn-based alloy material. This vibration damping structure is constructed of the vibration damping material. Examples of the vibration damping structure are not particularly limited, but any kinds of the structures may be used as long as the structures are constructed of using the above-described brace, fastener, anchor bolt, and the like.

<Civil Engineering and Construction Material>

The Cu—Al—Mn-based alloy material of the present invention can also be utilized as a civil engineering and construction material enabling prevention of the pollution of noises or vibrations. For example, the alloy material can be used by forming a composite material together with concrete.

<Others>

The Cu—Al—Mn-based alloy material of the present invention can also be used as a vibration-absorbing member for an aircraft, an automobile, or the like. The alloy material can also be applied to the field of transportation equipment intended for an effect of attenuating (reducing) noises.

EXAMPLES

The present invention will be described in more detail based on examples given below, but the invention is not meant to be limited by these.

Examples 1 to 49, Comparative Examples 1 to 34

Samples (specimen) of rods (wires) were produced under the following conditions.

As the raw materials that give the compositions of the Cu—Al—Mn-based alloy as indicated in Table 1-1 and Table 1-2, pure copper, pure Mn, pure Al, and if necessary materials of other optionally adding alloying elements were subjected respectively to melting in a high-frequency induction furnace. The Cu—Al—Mn-based alloys thus melted were cooled, to obtain ingots with diameter of 80 mm×length of 300 mm. The ingot thus obtained was subjected to hot extrusion at 800° C., and then rod materials having a diameter of 10 mm were produced, in Example 1, according to the working process illustrated in Process No. a shown in Table 2 (a flow chart thereof is presented in FIG. 5(*a*)), and in Comparative Example 1, according to the Process No. A shown in Table 2 (a flow chart thereof is presented in FIG. 5(*b*)). In the respective Examples and Comparative Examples other than those, rod materials were produced in the same manner as in Example 1 and Comparative Example 1, except that the working process was changed as indicated in Table 2.

The various processes for the steps described in Table 2 as well as Table 3-1, Tables 4-1 and 4-2 described below, correspond to the number indicated in parentheses ([Process #]) shown in FIG. 3, FIG. 5(*a*), or FIG. 5(*b*). Also, production conditions other than those shown in Table 2 (the number indicated in parenthesis ([#])) were as follows, and in the case where there were no particular descriptions in Table 2, Table 3-1, and Tables 4-1 to 4-2, the same conditions were adopted in all of the Examples and Comparative Examples.

For the melting and casting conditions of [1], as described above, the material was melted in the air and then was cooled and cast in a mold having a predetermined size.

The hot-working temperature of [2] was set to 800° C.

The intermediate annealing temperature of [3] was set to 550° C.

The intermediate annealing time of [4] was set to 100 minutes.

The cold-working ratio of [5] was set to 30%.

The number of repetitions of [3] to [5] in [6] was set to three times, and the cumulative cold-working ratio was set to 65%.

The speed of temperature raising from room temperature to a temperature range for obtaining an (α+β) phase in [7] was set to 30° C./min.

The retention temperature at a temperature range for obtaining an (α+β) phase in [8] was set to 500° C.

The retention time at the temperature range for obtaining an (α+β) phase in [9] was set to 60 minutes.

The retention temperature at a temperature range for obtaining a β single phase in [11] was set to 900° C.

The retention time at the temperature range for obtaining a β single phase in [12] was set to 120 minutes.

The retention temperature at a temperature range for obtaining an (α+β) phase in [14] was set to 500° C.

The retention time at the temperature range for obtaining an (α+β) phase in [15] was set to 60 minutes.

The retention temperature at a temperature range for obtaining a β single phase in [17] was set to 900° C.

The retention time at the temperature range for obtaining a β single phase in [18] was set to 120 minutes.

The rapid-cooling speed from the temperature range for obtaining a β single phase in [20] was set to 50° C./sec.

The aging temperature in [21] was set to 150° C.

The aging time in [22] was set to 20 minutes.

Texture observation was performed using an optical microscope or with the naked eye, and the analysis of crystalline orientation was performed using an EBSD method. For the evaluation of superelastic characteristics, loading and unloading of stress by a tensile test was repeated 100 times, a stress-strain curve (S-S curve) was determined, and the residual strain was determined, to evaluate the superelastic characteristics. The tensile test was carried out by cutting five specimens (N=5) from one sample material. In the following test results, the residual strain is the average value of five results.

The results of tests and evaluations of Examples according to the present invention and Comparative Examples are summarized in Tables 3-1 to 3-2 and Tables 4-1 to 4-2, together with the kind of the alloy material (see Tables 1-1 and 1-2) and the working process conditions (see Table 2, Table 3-1, and Tables 4-1 to 4-2).

The methods for tests and evaluations are described in detail below.

a. Recrystallized Texture Orientation

Before the evaluation of resistance to repeated deformations of superelasticity that will be described below, each of specimens was cut such that the plane facing the stress axis direction (working direction, RD) would be an observation plane, followed by embedding in an electrically conductive resin and subjected to vibration-type buffer finish (polishing). Measurement was carried out at four (4) points or more, by an EBSD method, in a measurement region having a size of about 800 μm×2,000 μm, under the conditions of a scan step of 5 μm. Herein, for the sample from which the recrystallized texture was analyzed, a specimen extracted at the time point of completion of [Step 5-4] was used. This is because, if the Cu—Al—Mn-based alloy of the present invention material is subjected up to [Step 5-10], which is the final step of the shape memory heat treatment, since crystal grains have grown coarsely, it becomes difficult to perform a texture analysis. Thus, when a specimen is extracted at a time point of completion of [Step 5-4], which is the step of the mid course, the distribution of the crystalline orientation before coarsening of the crystal grains can be checked. Thus, the samples were checked in the state described above. The crystalline orientations obtained from all of the measurement results, using an OIM software (trade name, manufactured by TSL), were plotted on an inverse pole figure (for example, please see FIG. 2(*a*) and FIG. 2(*b*)). As described above, the area of the atomic plane of crystal grains in which the angle formed by the normal line of the (111) plane and the working direction (RD) is in the range of 15° or larger, and the area of the atomic plane of crystal grains in which the angle formed by the normal line of the (101) plane and the working direction (RD) is in the range of 20° or less, were respectively determined. By dividing each of the areas by the total measurement area, the amount of existence of crystal grains in which the angle formed by the normal line of the (111) plane and the working direction (RD) was 15° or larger, and the amount of existence of crystal grains in which the angle formed by the normal line of the (101) plane and the working direction (RD) was 20° or less, were obtained.

According to the definitions of the present invention, a crystal grain, which has predetermined crystal grain sizes (a≥b), and in which the angle formed by the normal line of the (111) plane and the working direction (RD) was 15° or larger, is defined as crystal grain Y, and the amount of existence (area ratio) of the crystal grains Y is indicated as "amount of existence (%) of crystal grains Y" in the tables. Further, among the crystal grains Y, a crystal grain, in which the angle formed by the normal line of the (101) plane and the working direction (RD) was 20° or less, is defined as crystal grain Z, and the amount of existence of the crystal grains Z is indicated as "amount of existence (%) of crystal grains Z".

In regard to the amount of existence (%) of crystal grains Y, an amount of existence of 90% or more was judged excellent and was rated as "A"; an amount of existence of 85% or more and less than 90% was judged satisfactory and was rated as "B"; and an amount of existence of less than 85% was judged unacceptable and was rated as "C". These grades are indicated in the tables.

Further, in regard to the amount of existence (%) of crystal grains Z, an amount of existence of 60% or more was judged excellent and was rated as "A"; an amount of existence of 50% or more and less than 60% was judged satisfactory and was rated as "B"; and an amount of existence of less than 50% was judged unacceptable and was rated as "C". These grades are indicated in the tables.

An inverse pole figure produced from the results obtained by measuring the crystalline orientation observed in a plane facing the working direction (RD) of Example 1 by EBSD is presented in FIG. 2(*b*). Similarly, an inverse pole figure produced from the measurement results of Comparative Example 1 is presented in FIG. 2(*a*). As can be seen from the inverse pole figure marked with two kinds of oblique lines in the diagram of FIG. 2(*b*), the Cu—Al—Mn-based alloy material of Example 1 has the particularly preferable texture defined in the present invention.

Apart from those, in regard to the samples of Examples and Comparative Examples, the amount of existence of crystal grains Y in which the angle formed by the normal line of the (111) plane and the working direction (RD) is 15° or larger, and the amount of existence of crystal grains Z in which the angle formed by the normal line of the (101) plane and the working direction (RD) is 20° or less, were measured in the same manner by the EBSD method.

b. Gain Size of a Recrystallized Texture

Figure 7A:
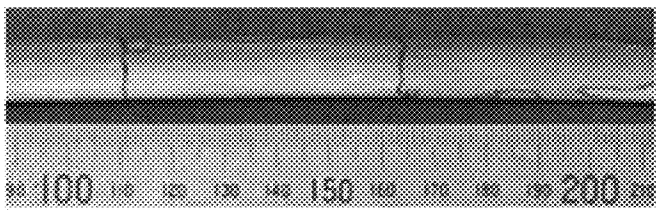
FIG. 7(*a*) is a photograph taken for the sample obtained in Example 1 (Process No. a), and FIG. 7(*b*) shows a photograph taken for the sample obtained in Comparative Example 1 (Process No. A), the photographs indicating the crystal grain lengths of crystal grains.
Figure 7B:
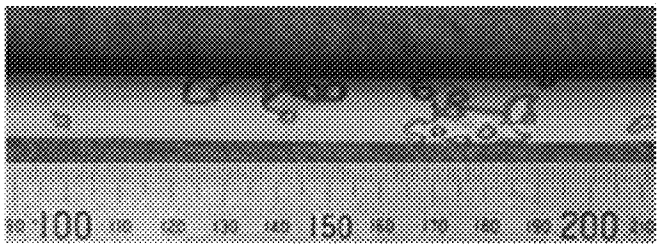

Before a tensile test for an evaluation of the resistance to repeated deformations of superelasticity described below, a specimen in a rod form was etched on the surface with an aqueous solution of ferric chloride, and the crystal crystal grain size was checked. The entire length of the specimen to be checked was not particularly set up, but it was considered that a length equal to or longer than the gauge length of the tensile test that will be described below would be needed. Thus, in the present invention, a length of 100 mm or more was used. The respective samples of Example 1 and Comparative Example 1 were etched with an aqueous solution of ferric chloride, and then texture photographs were taken. The photographs are shown in FIG. 7(*a*) for Example 1, and in FIG. 7(*b*) for Comparative Example 1. Further, a schematic diagram for the method of measuring the crystal grain size is as shown in FIG. 1. According to the present invention, it is required that the amount of existence of crystal grains (hereinafter, crystal grains X) in which the crystal grain length (hereinafter, $a_x$) in the working direction (RD) with respect to the width or diameter R of the sample is R/2 or less, and the crystal grain length (hereinafter, $b_x$) in a direction perpendicular to the stress axis is R/4 or less, be 15% or less. Further, in the crystal grains Y (and crystal grains Z), it is required that the relationships of a>b be satisfied.

According to the definition in the present invention, a crystal grain which satisfies the predetermined relationships of crystal grain sizes ($a_x$ and $b_x$) is designated as crystal grain X, and the amount of existence (area ratio) of the crystal grains X is designated as "amount of existence (%) of crystal grains X" in the tables. When the crystal grain sizes of Example 1 and Comparative Example 1 were compared, in Example 1, the amount of crystal grains X was 15% or less, and the relationships of a≥b was satisfied in all of the crystal grains Y (and crystal grains Z). On the other hand, in Comparative Example 1, the crystal grain X existed at an area proportion of more than 15%, and thus the definition in the present invention was not satisfied.

Among the crystal grains of the rod material for which the crystal grain size was measured by the method described above, a sample in which the existence proportion of crystal grains X was 10% or less of the total area of measurement was judged excellent and was rated as "A"; a sample in which the existence proportion of crystal grains X was more than 10% and 15% or less was judged satisfactory and was rated as "B"; and a sample in which the existence proportion was more than 15% was judged poor and was rated as "C". The ratings are indicated in the tables.

Further, in regard to the crystal grain size in the crystal grains Y (and crystal grains Z), since it is required that the relationships of a≥b be satisfied, the crystal grain size was judged based on the average value of the value of a/b. The value of a/b of a crystal grain Y is indicated as "a/b size of crystal grain Y" in the tables. A sample in which the value of a/b was 1.5 or more was judged excellent and was rated as "A"; a sample in which the value of a/b was less than 1.5 and 1.0 or more was judged satisfactory and was rated as "B"; and a sample in which the value of a/b was less than 1.0 was judged poor and was rated as "C". The ratings are presented in the tables.

In the case where the sum of the amount of existence of crystal grains X and the amount of existence of crystal grains Y (the crystal grains Y include crystal grains Z) was less than 100%, other crystal grains existed, which had a size other than the sizes of the crystal grains X and the crystal grains Y. In this case, the size of the other crystal grains having a size other than the crystal grains X and the crystal grains Y, was larger than the crystal grains X and smaller than the crystal grains Y.

c. Resistance to Repeated Deformations [Residual Strain after Repeating 100 Cycles—Loading and Unloading of 5% Strain]

Loading and unloading of a stress that resulted in a strain of 5% were repeated, and a stress-strain curve (a S-S curve) was determined. The residual strain after one cycle and the residual strain after 100 cycles were determined (see FIG. 4(*a*)).

Twenty specimens having a length of 170 mm were cut out from each sample and were subjected to the test. The residual strain after 100 cycles of loading and unloading of a strain of 5% was determined from the stress-strain curve (the S-S curve). In the tables, the residual strain after 100 cycles is indicated as "residual strain after cycles".

Regarding the test conditions, a tensile test of alternately repeating loading and unloading of a stress that gives a strain amount of 5% at a gauge length of 100 mm was carried out 100 times at a test speed of 5%/min. An evaluation was carried out according to the following criteria.

The case where the residual strain was 1.5% or less, was judged to have excellent superelastic characteristics and was rated as "A"; the case where the residual strain was 2.0% or less but more than 1.5%, was judged to have satisfactory superelastic characteristics and was rated as "B"; and the case where the residual strain was large such as more than 2.0%, was judged to have unacceptable superelastic characteristics and was rated as "C". The results are shown in the tables.

In regard to the representative residual strain, a stress-strain curve (a S-S curve) is presented in FIGS. 6(*a*) and 6(*b*). FIG. 6(*a*) shows the results of a specimen of Example 1 produced based on Process No. a, and FIG. 6(*b*) shows the results of a specimen of Comparative Example 1 produced based on Process No. A. As can be seen from FIG. 6(*a*) and FIG. 6(*b*), the residual strain (%) after 100 cycles of loading and unloading of 5% strain, was 1.4% in Example 1, and 2.2% in Comparative Example 1.

d. Difference of Stress in 5% Strain and 0.2% Strain

Loading and unloading of a stress that gives 5% strain is performed, and the difference between the stress value for 0.2% proof stress and the stress value exhibited when a strain of 5% is loaded is determined, as the "difference of stress" from the stress-strain curve (the S-S curve) (see FIG. 4(*b*)). Regarding the "difference of stress" described above, for example, when the amount of existence of crystal grains in which the angle formed by the normal line of the (101) plane, which is a preferable crystalline orientation, and the working direction is 20° or less cannot be appropriately controlled in the case where working has been insufficiently achieved or the like, this "difference of stress" occurs. Further, even in the case where the crystalline orientation is oriented in the <101> direction, if the crystal grain size does not satisfy the conditions defined in the present invention, the amount of residual strain becomes large. Thus, the "difference of stress" between the stress value of a 0.2% proof stress and the stress value exhibited in the case where a strain of 5% is loaded, becomes larger. This difference of stress is such that, for example, in the case where the alloy material is used as a construction material, a smaller value of stress that is transferred to the building is preferred. Thus, it can be said that as the difference of stress is smaller, the alloy material has more excellent in characteristics. Accordingly, when the "difference of stress" was measured by the method described above, a sample having a difference of stress of 30 MPa or less was judged excellent and was rated as "A"; a sample having a difference of stress of more than 30 MPa and 50 MPa or less was judged satisfactory and was rated as "B"; and a sample having a difference of stress of more than 50 MPa was judged poor and was rated as "C". The ratings are presented in the tables.

TABLE 1

| Alloy | Adding elements (mass %) | | | | | | | | | | | | | | |
|---|---|---|---|---|---|---|---|---|---|---|---|---|---|---|---|
| No. | Al | Mn | Ni | Co | Fe | Ti | V | Cr | Si | Sn | Zn | B | C | Pr | Nd |
| 1 | 8.2 | 11.2 | — | — | — | — | — | — | — | — | — | — | — | — | — |
| 2 | 7.8 | 12.4 | — | — | — | — | — | — | — | — | — | — | — | — | — |
| 3 | 9.8 | 8.0 | — | — | — | — | — | — | — | — | — | — | — | — | — |
| 4 | 3.0 | 11.0 | — | — | — | — | — | — | — | — | — | — | — | — | — |
| 5 | 10.0 | 10.8 | — | — | — | — | — | — | — | — | — | — | — | — | — |
| 6 | 8.0 | 5.0 | — | — | — | — | — | — | — | — | — | — | — | — | — |
| 7 | 8.0 | 19.8 | — | — | — | — | — | — | — | — | — | — | — | — | — |
| 8 | 8.2 | 11.2 | 1.00 | — | — | — | — | — | — | — | — | — | — | — | — |
| 9 | 8.2 | 11.2 | — | 0.50 | — | — | — | — | — | — | — | — | — | — | — |
| 10 | 8.2 | 11.2 | 2.50 | — | — | — | — | — | — | — | — | — | — | — | — |
| 11 | 8.2 | 11.2 | 2.50 | — | 0.50 | — | — | — | — | — | — | — | — | — | — |
| 12 | 8.2 | 11.2 | — | — | — | 0.50 | — | — | — | — | — | — | — | — | — |
| 13 | 8.2 | 11.2 | — | — | — | — | 0.50 | — | — | — | — | — | — | — | — |
| 14 | 8.2 | 11.2 | — | — | — | — | — | 0.50 | — | 0.10 | — | 0.003 | — | — | — |
| 15 | 8.2 | 11.2 | — | — | — | 0.30 | — | — | 0.05 | — | — | — | 0.003 | — | — |
| 16 | 8.2 | 11.2 | — | — | — | — | 0.10 | — | — | 0.50 | — | — | — | — | — |
| 17 | 8.2 | 11.2 | — | — | — | — | 0.10 | — | — | — | 0.50 | — | — | — | — |
| 18 | 8.2 | 11.2 | — | — | — | — | — | — | — | — | — | — | — | 0.03 | 0.01 |
| 19 | 8.2 | 11.2 | — | — | — | — | — | 0.40 | — | 0.10 | — | — | — | — | — |
| 20 | 8.2 | 11.2 | — | — | — | 0.20 | — | 0.30 | — | — | — | — | — | — | — |
| 21 | 2.8 | 11.0 | — | — | — | — | — | — | — | — | — | — | — | — | — |
| 22 | 11.0 | 10.5 | — | — | — | — | — | — | — | — | — | — | — | — | — |
| 23 | 18.0 | 10.5 | — | — | — | — | — | — | — | — | — | — | — | — | — |
| 24 | 7.9 | 4.0 | — | — | — | — | — | — | — | — | — | — | — | — | — |
| 25 | 7.8 | 21.0 | — | — | — | — | — | — | — | — | — | — | — | — | — |
| 26 | 8.2 | 11.2 | 6.00 | — | — | — | — | — | — | — | — | — | — | — | — |
| 27 | 8.2 | 11.2 | — | 4.50 | — | — | — | — | — | — | — | — | — | — | — |
| 28 | 8.2 | 11.2 | 3.50 | — | — | — | — | — | — | — | — | — | — | — | — |
| 29 | 8.2 | 11.2 | 0.50 | — | 4.00 | — | — | — | — | — | — | — | — | — | — |
| 30 | 8.2 | 11.2 | — | — | — | 3.00 | — | — | — | — | — | — | — | — | — |
| 31 | 8.2 | 11.2 | — | — | — | — | 1.50 | — | — | — | — | — | — | — | — |
| 32 | 8.2 | 11.2 | — | — | — | — | — | 3.00 | — | 5.00 | — | 0.10 | — | — | — |
| 33 | 8.2 | 11.2 | — | — | — | 0.30 | — | — | 4.50 | — | — | — | — | — | |
| 34 | 8.2 | 11.2 | — | — | — | — | 0.10 | — | — | 2.00 | — | — | — | — | — |
| 35 | 8.2 | 11.2 | — | — | — | — | 2.00 | — | — | — | 5.50 | — | — | — | — |
| 36 | 8.2 | 11.2 | — | — | — | — | — | — | — | — | — | — | — | 6.00 | — |
| 37 | 8.2 | 11.2 | — | — | — | — | — | — | — | — | — | — | 2.00 | — | 0.01 |
| 38 | 8.2 | 11.2 | — | — | — | — | — | — | — | — | — | — | — | — | 5.50 |
| 39 | 8.2 | 11.2 | — | — | — | — | — | 3.50 | — | 0.10 | — | — | — | — | — |
| 40 | 8.2 | 11.2 | — | 1.00 | 1.50 | 1.50 | — | 2.00 | — | 1.50 | 1.00 | — | 1.00 | — | 0.80 |
| 41 | 8.2 | 11.2 | — | — | — | 2.00 | — | 3.00 | — | — | — | — | — | — | — |

Note:
"—" means not added

TABLE 2

| Process No. | [3] Intermediate annealing temp. (° C.) | [5] Cold-working ratio (%) | [6] [3] to [5] repetition times (times) | [6] Cumilative working ratio (%) | [8] Intermediate (α + β) retention temp. (° C.) | [9] Intermediate (α + β) retention time (min) | [10] Temp. raising speed (° C./min) | Remarks |
|---|---|---|---|---|---|---|---|---|
| a | 550 | 30 | 3 | 65 | 500 | 60 | 1 | This invention |
| b | 550 | 30 | 3 | 65 | 500 | 60 | 1 | |
| c | 550 | 30 | 3 | 65 | 500 | 60 | 11 | |
| d | 550 | 30 | 3 | 65 | 500 | 60 | 1 | |
| e | 550 | 30 | 3 | 65 | 500 | 60 | 20 | |
| f | 550 | 30 | 3 | 65 | 500 | 60 | 1 | |
| g | 550 | 30 | 3 | 65 | 500 | 60 | 20 | |
| h | 550 | 35 | 1 | 35 | 500 | 60 | 1 | |
| i | 450 | 30 | 3 | 65 | 500 | 60 | 1 | |
| j | 650 | 30 | 3 | 65 | 500 | 60 | 1 | |
| k | 450 | 30 | 3 | 65 | 500 | 60 | 11 | |
| l | 650 | 30 | 3 | 65 | 500 | 60 | 11 | |
| m | 450 | 30 | 3 | 65 | 500 | 60 | 1 | |
| n | 650 | 30 | 3 | 65 | 500 | 60 | 1 | |
| o | 450 | 35 | 1 | 35 | 500 | 60 | 1 | |
| p | 650 | 35 | 1 | 35 | 500 | 60 | 1 | |
| q | 450 | 30 | 3 | 65 | 500 | 60 | 20 | |
| r | 650 | 30 | 3 | 65 | 500 | 60 | 20 | |
| s | 450 | 30 | 3 | 65 | 500 | 60 | 1 | |
| t | 650 | 30 | 3 | 65 | 500 | 60 | 1 | |
| u | 500 | 30 | 3 | 65 | 500 | 60 | 1 | |
| v | 500 | 30 | 3 | 65 | 500 | 60 | 1 | |
| w | 500 | 30 | 3 | 65 | 500 | 60 | 1 | |
| x | 500 | 30 | 3 | 65 | 400 | 60 | 0.1 | |
| y | 500 | 30 | 3 | 65 | 650 | 60 | 0.1 | |
| z | 500 | 30 | 3 | 65 | 500 | 60 | 0.1 | |

| Process No. | [12] β phase retention time (min) | [13] Temp. lowering speed (° C./min) | [15] (α + β) retention time (min) | [16] Temp. raising speed (° C./min) | [18] β phase retention time (min) | [19] [10] to [18] repetition times (times) | Remarks |
|---|---|---|---|---|---|---|---|
| a | 120 | 1 | 60 | 1 | 120 | 2 | This invention |
| b | 120 | 1 | 60 | 1 | 120 | 3 | |
| c | 120 | 1 | 60 | 11 | 120 | 2 | |
| d | 120 | 11 | 60 | 1 | 120 | 2 | |
| e | 120 | 1 | 60 | 20 | 120 | 2 | |
| f | 120 | 20 | 60 | 1 | 120 | 2 | |
| g | 120 | 20 | 60 | 20 | 120 | 2 | |
| h | 120 | 1 | 60 | 1 | 120 | 2 | |
| i | 120 | 1 | 60 | 1 | 120 | 2 | |
| j | 120 | 1 | 60 | 1 | 120 | 2 | |
| k | 120 | 1 | 60 | 11 | 120 | 2 | |
| l | 120 | 1 | 60 | 11 | 120 | 2 | |
| m | 120 | 11 | 60 | 1 | 120 | 2 | |
| n | 120 | 11 | 60 | 1 | 120 | 2 | |
| o | 120 | 1 | 60 | 1 | 120 | 2 | |
| p | 120 | 1 | 60 | 1 | 120 | 2 | |
| q | 120 | 20 | 60 | 20 | 120 | 2 | |
| r | 120 | 20 | 60 | 20 | 120 | 2 | |
| s | 120 | 1 | 60 | 1 | 120 | 3 | |
| t | 120 | 1 | 60 | 1 | 120 | 3 | |
| u | 480 | 1 | 20 | 1 | 5 | 2 | |
| v | 480 | 1 | 20 | 1 | 480 | 2 | |
| w | 480 | 1 | 480 | 1 | 120 | 2 | |
| x | 5 | 0.1 | 60 | 0.1 | 480 | 3 | |
| y | 5 | 0.1 | 60 | 0.1 | 480 | 3 | |
| z | 5 | 0.1 | 60 | 0.1 | 480 | 3 | |

| Process No. | [3] Intermediate annealing temp. (° C.) | [5] Cold-working ratio (%) | [6] [3] to [5] repetition times (times) | [6] Cumilative working ratio (%) | [8] Intermediate (α + β) retention temp. (° C.) | [9] Intermediate (α + β) retention time (min) | [10] Temp. raising speed (° C./min) | Remarks |
|---|---|---|---|---|---|---|---|---|
| A | 550 | 30 | 3 | 65 | 500 | 60 | 1 | Comparative example |
| B | 450 | 30 | 3 | 65 | 500 | 60 | 1 | |
| C | 650 | 30 | 3 | 65 | 500 | 60 | 1 | |
| D | 550 | 30 | 3 | 65 | 500 | 0 | 1 | |

TABLE 2-continued

| | | | | | | | |
|---|---|---|---|---|---|---|---|
| E | 550 | 30 | 3 | 65 | 500 | 60 | 25 |
| F | 550 | 30 | 3 | 65 | 500 | 60 | 1 |
| G | 550 | 30 | 3 | 65 | 500 | 60 | 25 |
| H | 350 | 30 | 3 | 65 | 500 | 60 | 1 |
| I | 700 | 30 | 3 | 65 | 500 | 60 | 1 |
| J | 550 | 28 | 1 | 28 | 500 | 60 | 1 |

| Process No. | [12] β phase retention time (min) | [13] Temp. lowering speed (° C./min) | [15] (α + β) retention time (min) | [16] Temp. raising speed (° C./min) | [18] β phase retention time (min) | [19] [10] to [18] repetition times (times) | Remarks |
|---|---|---|---|---|---|---|---|
| A | 120 | 1 | 60 | 1 | 120 | 1 | Comparative example |
| B | 120 | 1 | 60 | 1 | 120 | 1 | |
| C | 120 | 1 | 60 | 1 | 120 | 1 | |
| D | 120 | 1 | 60 | 1 | 120 | 2 | |
| E | 120 | 1 | 60 | 25 | 120 | 2 | |
| F | 120 | 25 | 60 | 1 | 120 | 2 | |
| G | 120 | 25 | 60 | 25 | 120 | 2 | |
| H | 120 | 1 | 60 | 1 | 120 | 2 | |
| I | 120 | 1 | 60 | 1 | 120 | 2 | |
| J | 120 | 1 | 60 | 1 | 120 | 2 | |

TABLE 3

| | | | Production conditions | | | | | | |
|---|---|---|---|---|---|---|---|---|---|
| | | | [3] Inter- | [5] | [6] | | [8] Inter-mediate | [9] Inter-mediate | [10] |
| | Alloy No. | Process No. | mediate annealing temp. (° C.) | Cold-working ratio (%) | [3] to [5] repetition times (times) | Cumilative working ratio (%) | (α + β) retention temp. (° C.) | (α + β) retention time (min) | Temp. raising speed (° C./min) |
| Ex 1 | 1 | a | 550 | 30 | 3 | 65 | 500 | 60 | 1 |
| Ex 2 | 1 | b | 550 | 30 | 3 | 65 | 500 | 60 | 1 |
| Ex 3 | 1 | c | 550 | 30 | 3 | 65 | 500 | 60 | 11 |
| Ex 4 | 1 | d | 550 | 30 | 3 | 65 | 500 | 60 | 1 |
| Ex 5 | 1 | e | 550 | 30 | 3 | 65 | 500 | 60 | 20 |
| Ex 6 | 1 | f | 550 | 30 | 3 | 65 | 500 | 60 | 1 |
| Ex 7 | 1 | g | 550 | 30 | 3 | 65 | 500 | 60 | 20 |
| Ex 8 | 1 | h | 550 | 35 | 1 | 35 | 500 | 60 | 1 |
| Ex 9 | 1 | i | 450 | 30 | 3 | 65 | 500 | 60 | 1 |
| Ex 10 | 1 | j | 650 | 30 | 3 | 65 | 500 | 60 | 1 |
| Ex 11 | 1 | k | 450 | 30 | 3 | 65 | 500 | 60 | 11 |
| Ex 12 | 1 | l | 650 | 30 | 3 | 65 | 500 | 60 | 11 |
| Ex 13 | 1 | m | 450 | 30 | 3 | 65 | 500 | 60 | 1 |
| Ex 14 | 1 | n | 650 | 30 | 3 | 65 | 500 | 60 | 1 |
| Ex 15 | 1 | o | 450 | 35 | 1 | 35 | 500 | 60 | 1 |
| Ex 16 | 1 | p | 650 | 35 | 1 | 35 | 500 | 60 | 1 |
| Ex 17 | 1 | q | 450 | 30 | 3 | 65 | 500 | 60 | 20 |
| Ex 18 | 1 | r | 650 | 30 | 3 | 65 | 500 | 60 | 20 |
| Ex 19 | 1 | s | 450 | 30 | 3 | 65 | 500 | 60 | 1 |
| Ex 20 | 1 | t | 650 | 30 | 3 | 65 | 500 | 60 | 1 |
| Ex 21 | 1 | u | 500 | 30 | 3 | 65 | 500 | 60 | 1 |
| Ex 22 | 1 | v | 500 | 30 | 3 | 65 | 500 | 60 | 1 |
| Ex 23 | 1 | w | 500 | 30 | 3 | 65 | 500 | 60 | 1 |
| Ex 24 | 1 | x | 500 | 30 | 3 | 65 | 400 | 60 | 0.1 |
| Ex 25 | 1 | y | 500 | 30 | 3 | 65 | 650 | 60 | 0.1 |
| Ex 26 | 1 | z | 500 | 30 | 3 | 65 | 500 | 60 | 0.1 |

| | | | Production conditions | | | | | |
|---|---|---|---|---|---|---|---|---|
| | Alloy No. | Process No. | [12] β phase retention time (min) | [13] Temp. lowering speed (° C./min) | [15] (α + β) retention time (min) | [16] Temp. raising speed (° C./min) | [18] β phase retention time (min) | [19] [11] to [18] repetition times (times) |
| Ex 1 | 1 | a | 120 | 1 | 60 | 1 | 120 | 2 |
| Ex 2 | 1 | b | 120 | 1 | 60 | 1 | 120 | 3 |
| Ex 3 | 1 | c | 120 | 1 | 60 | 11 | 120 | 2 |
| Ex 4 | 1 | d | 120 | 11 | 60 | 1 | 120 | 2 |
| Ex 5 | 1 | e | 120 | 1 | 60 | 20 | 120 | 2 |

TABLE 3-continued

| | | | | | | | | |
|---|---|---|---|---|---|---|---|---|
| Ex 6 | 1 | f | 120 | 20 | 60 | 1 | 120 | 2 |
| Ex 7 | 1 | g | 120 | 20 | 60 | 20 | 120 | 2 |
| Ex 8 | 1 | h | 120 | 1 | 60 | 1 | 120 | 2 |
| Ex 9 | 1 | i | 120 | 1 | 60 | 1 | 120 | 2 |
| Ex 10 | 1 | j | 120 | 1 | 60 | 1 | 120 | 2 |
| Ex 11 | 1 | k | 120 | 1 | 60 | 11 | 120 | 2 |
| Ex 12 | 1 | l | 120 | 1 | 60 | 11 | 120 | 2 |
| Ex 13 | 1 | m | 120 | 11 | 60 | 1 | 120 | 2 |
| Ex 14 | 1 | n | 120 | 11 | 60 | 1 | 120 | 2 |
| Ex 15 | 1 | o | 120 | 1 | 60 | 1 | 120 | 2 |
| Ex 16 | 1 | p | 120 | 1 | 60 | 1 | 120 | 2 |
| Ex 17 | 1 | q | 120 | 20 | 60 | 20 | 120 | 2 |
| Ex 18 | 1 | r | 120 | 20 | 60 | 20 | 120 | 2 |
| Ex 19 | 1 | s | 120 | 1 | 60 | 1 | 120 | 3 |
| Ex 20 | 1 | t | 120 | 1 | 60 | 1 | 120 | 3 |
| Ex 21 | 1 | u | 480 | 1 | 20 | 1 | 5 | 2 |
| Ex 22 | 1 | v | 480 | 1 | 20 | 1 | 480 | 2 |
| Ex 23 | 1 | w | 480 | 1 | 480 | 1 | 120 | 2 |
| Ex 24 | 1 | x | 5 | 0.1 | 60 | 0.1 | 480 | 3 |
| Ex 25 | 1 | y | 5 | 0.1 | 60 | 0.1 | 480 | 3 |
| Ex 26 | 1 | z | 5 | 0.1 | 60 | 0.1 | 480 | 3 |

| | | | Production conditions | | | | | | |
|---|---|---|---|---|---|---|---|---|---|
| | | | [3] | [5] | [6] | | [8] | [9] | [10] |
| | Alloy No. | Process No. | Intermediate annealing temp. (° C.) | Cold-working ratio (%) | [3] to [5] repetition times (times) | Cumulative working ratio (%) | Intermediate (α + β) retention temp. (° C.) | Intermediate (α + β) retention time (min) | Temp. raising speed (° C./min) |
| CEx 1 | 1 | A | 550 | 30 | 3 | 65 | 500 | 60 | 1 |
| CEx 2 | 1 | B | 450 | 30 | 3 | 65 | 500 | 60 | 1 |
| CEx 3 | 1 | C | 650 | 30 | 3 | 65 | 500 | 60 | 1 |
| CEx 4 | 1 | D | 550 | 30 | 3 | 65 | 500 | 0 | 1 |
| CEx 5 | 1 | E | 550 | 30 | 3 | 65 | 500 | 60 | 25 |
| CEx 6 | 1 | F | 550 | 30 | 3 | 65 | 500 | 60 | 1 |
| CEx 7 | 1 | G | 550 | 30 | 3 | 65 | 500 | 60 | 25 |
| CEx 8 | 1 | H | 380 | 30 | 3 | 65 | 500 | 60 | 1 |
| CEx 9 | 1 | I | 700 | 30 | 3 | 65 | 500 | 60 | 1 |
| CEx 10 | 1 | J | 550 | 28 | 1 | 28 | 500 | 60 | 1 |

| | | | Production conditions | | | | | |
|---|---|---|---|---|---|---|---|---|
| | Alloy No. | Process No. | [12] β phase retention time (min) | [13] Temp. lowering speed (° C./min) | [15] (α + β) retention time (min) | [16] Temp. raising speed (° C./min) | [18] β phase retention time (min) | [19] [11] to [18] repetition times (times) |
| CEx 1 | 1 | A | 120 | 1 | 60 | 1 | 120 | 1 |
| CEx 2 | 1 | B | 120 | 1 | 60 | 1 | 120 | 1 |
| CEx 3 | 1 | C | 120 | 1 | 60 | 1 | 120 | 1 |
| CEx 4 | 1 | D | 120 | 1 | 60 | 1 | 120 | 2 |
| CEx 5 | 1 | E | 120 | 1 | 60 | 25 | 120 | 2 |
| CEx 6 | 1 | F | 120 | 25 | 60 | 1 | 120 | 2 |
| CEx 7 | 1 | G | 120 | 25 | 60 | 25 | 120 | 2 |
| CEx 8 | 1 | H | 120 | 1 | 60 | 1 | 120 | 2 |
| CEx 9 | 1 | I | 120 | 1 | 60 | 1 | 120 | 2 |
| CEx 10 | 1 | J | 120 | 1 | 60 | 1 | 120 | 2 |

| | Texture characteristics | | | | | | | | | | | |
|---|---|---|---|---|---|---|---|---|---|---|---|---|
| | Amount of existence of fine-grains X % | Judgement | a/b size of grain Y | Judgement | Amount of existence of grains Y % | Judgement | Residual strain after cycles % | Judgement | Amount of existence of grains Z % | Judgement | Difference of stress MPa | Judgement |
| Ex 1 | 12 | B | 2.5 | A | 88 | B | 1.4 | A | 60 | A | 28 | A |
| Ex 2 | 9 | A | 2.8 | A | 91 | A | 0.8 | A | 61 | A | 27 | A |
| Ex 3 | 13 | B | 1.8 | A | 87 | B | 1.5 | B | 55 | B | 37 | B |
| Ex 4 | 13 | B | 2.0 | A | 87 | B | 1.5 | B | 57 | B | 32 | B |
| Ex 5 | 14 | B | 1.5 | A | 86 | B | 1.8 | B | 52 | B | 40 | B |
| Ex 6 | 15 | B | 1.2 | B | 85 | B | 1.8 | B | 53 | B | 40 | B |

TABLE 3-continued

| | | | | | | | | | | | | |
|---|---|---|---|---|---|---|---|---|---|---|---|---|
| Ex 7 | 15 | B | 1.1 | B | 85 | B | 1.9 | B | 54 | B | 35 | B |
| Ex 8 | 15 | B | 2.2 | A | 85 | B | 2.0 | B | 59 | B | 31 | B |
| Ex 9 | 9 | A | 2.8 | A | 91 | A | 1.2 | A | 62 | A | 28 | A |
| Ex 10 | 11 | B | 2.1 | A | 89 | B | 1.5 | A | 50 | B | 50 | B |
| Ex 11 | 11 | B | 2.0 | A | 89 | B | 1.4 | A | 60 | A | 30 | A |
| Ex 12 | 12 | B | 1.7 | A | 88 | B | 1.5 | A | 51 | B | 49 | B |
| Ex 13 | 11 | B | 2.1 | A | 89 | B | 1.5 | A | 63 | A | 27 | A |
| Ex 14 | 13 | B | 1.6 | A | 87 | B | 1.6 | B | 50 | B | 48 | B |
| Ex 15 | 12 | B | 2.7 | A | 88 | B | 2.0 | B | 62 | A | 27 | A |
| Ex 16 | 15 | B | 2.3 | A | 85 | B | 2.0 | B | 50 | B | 50 | B |
| Ex 17 | 14 | B | 1.2 | B | 86 | B | 1.9 | B | 61 | A | 30 | A |
| Ex 18 | 15 | B | 1.0 | B | 85 | B | 2.0 | B | 51 | B | 47 | B |
| Ex 19 | 8 | A | 2.9 | A | 92 | A | 0.7 | A | 62 | A | 28 | A |
| Ex 20 | 10 | A | 2.7 | A | 90 | A | 1.2 | A | 52 | B | 46 | B |
| Ex 21 | 15 | B | 1.4 | B | 90 | A | 1.5 | A | 60 | A | 50 | B |
| Ex 22 | 9 | A | 2.8 | A | 91 | A | 1.0 | A | 60 | A | 30 | A |
| Ex 23 | 10 | A | 2.6 | A | 90 | A | 1.2 | A | 61 | A | 27 | A |
| Ex 24 | 10 | A | 2.7 | A | 90 | A | 1.9 | B | 60 | A | 30 | A |
| Ex 25 | 9 | A | 3.0 | A | 90 | A | 2 | B | 62 | A | 30 | A |
| Ex 26 | 10 | A | 2.8 | A | 91 | A | 0.7 | A | 60 | A | 27 | A |

| | Texture characteristics | | | | | | | | | | | |
|---|---|---|---|---|---|---|---|---|---|---|---|---|
| | Amount of existence of fine-grains X % | Judge-ment | a/b size of grain Y | Judge-ment | Amount of existence of grains Y % | Judge-ment | Residual strain after cycles % | Judge-ment | Amount of existence of grains Z % | Judge-ment | Difference of stress MPa | Judge-ment |
| CEx 1 | 21 | C | 2.5 | A | 70 | C | 2.2 | C | 60 | A | 30 | A |
| CEx 2 | 22 | C | 2.6 | A | 75 | C | 2.1 | C | 61 | A | 29 | A |
| CEx 3 | 30 | C | 2.2 | A | 70 | C | 2.3 | C | 55 | B | 37 | B |
| CEx 4 | 20 | C | 2.3 | A | 70 | C | 2.2 | C | 57 | B | 32 | B |
| CEx 5 | 15 | B | 0.8 | C | 75 | C | 2.5 | C | 53 | B | 40 | B |
| CEx 6 | 13 | B | 0.7 | C | 72 | C | 2.6 | C | 54 | B | 35 | B |
| CEx 7 | 15 | C | 0.5 | C | 70 | C | 2.6 | C | 56 | B | 36 | B |
| CEx 8 | Impposible to produce | | | | | | | | | | | |
| CEx 9 | 21 | C | 1.5 | A | 67 | C | 3.0 | C | 20 | C | 52 | C |
| CEx 10 | 14 | B | 1.5 | A | 65 | C | 2.7 | C | 15 | C | 68 | C |

Note:
'Ex' means Example according to this invention.
'CEx' means Comparative Example.

TABLE 4

| | | | Production conditions | | | |
|---|---|---|---|---|---|---|
| | Alloy No. | Process No. | [10] Temp. raising speed (° C./min) | [13] Temp. lowering speed (° C./min) | [16] Temp. raising speed (° C./min) | [19] [11] to [18] repetition times (times) |
| Ex 27 | 1 | a | 1 | 1 | 1 | 2 |
| Ex 28 | 2 | a | 1 | 1 | 1 | 2 |
| Ex 29 | 3 | a | 1 | 1 | 1 | 2 |
| Ex 30 | 4 | a | 1 | 1 | 1 | 2 |
| Ex 31 | 5 | a | 1 | 1 | 1 | 2 |
| Ex 32 | 6 | a | 1 | 1 | 1 | 2 |
| Ex 33 | 7 | a | 1 | 1 | 1 | 2 |
| Ex 34 | 7 | b | 1 | 1 | 1 | 3 |
| Ex 35 | 8 | a | 1 | 1 | 1 | 2 |
| Ex 36 | 9 | a | 1 | 1 | 1 | 2 |
| Ex 37 | 9 | c | 11 | 1 | 11 | 2 |
| Ex 38 | 10 | a | 1 | 1 | 1 | 2 |
| Ex 39 | 10 | d | 1 | 11 | 1 | 2 |
| Ex 40 | 11 | a | 1 | 1 | 1 | 2 |
| Ex 41 | 12 | a | 1 | 1 | 1 | 2 |
| Ex 42 | 13 | a | 1 | 1 | 1 | 2 |
| Ex 43 | 14 | a | 1 | 1 | 1 | 2 |
| Ex 44 | 15 | a | 1 | 1 | 1 | 2 |
| Ex 45 | 16 | a | 1 | 1 | 1 | 2 |
| Ex 46 | 17 | a | 1 | 1 | 1 | 2 |
| Ex 47 | 18 | a | 1 | 1 | 1 | 2 |

TABLE 4-continued

| | | | | | |
|---|---|---|---|---|---|
| Ex 48 | 19 | a | 1 | 1 | 1 | 2 |
| Ex 49 | 20 | a | 1 | 1 | 1 | 2 |

| | Texture characteristics | | | | | | | | | | | |
|---|---|---|---|---|---|---|---|---|---|---|---|---|
| | Amount of existence of fine-grains X % | Judge-ment | a/b size of grain Y | Judge-ment | Amount of existence of grains Y % | Judge-ment | Residual strain after cycles % | Judge-ment | Amount of existence of grains Z % | Judge-ment | Difference of stress MPa | Judge-ment |
| Ex 27 | 12 | B | 2.5 | A | 88 | B | 1.4 | A | 55 | B | 37 | B |
| Ex 28 | 13 | B | 2.4 | A | 87 | B | 1.5 | A | 54 | B | 38 | B |
| Ex 29 | 12 | B | 2.6 | A | 88 | B | 1.4 | A | 56 | B | 36 | B |
| Ex 30 | 14 | B | 2.2 | A | 86 | B | 1.7 | B | 55 | B | 37 | B |
| Ex 31 | 12 | B | 2.5 | A | 88 | B | 1.4 | A | 57 | B | 32 | B |
| Ex 32 | 11 | B | 2.5 | A | 89 | B | 1.4 | A | 52 | B | 42 | B |
| Ex 33 | 15 | B | 1.4 | B | 85 | B | 1.9 | B | 53 | B | 40 | B |
| Ex 34 | 14 | B | 1.8 | A | 86 | B | 1.4 | A | 57 | B | 33 | B |
| Ex 35 | 12 | B | 2.4 | A | 88 | B | 1.0 | A | 63 | A | 27 | A |
| Ex 36 | 10 | A | 2.9 | A | 90 | A | 1.1 | A | 60 | A | 30 | A |
| Ex 37 | 10 | A | 2.7 | A | 85 | B | 1.4 | A | 55 | B | 39 | B |
| Ex 38 | 15 | B | 1.4 | B | 85 | B | 1.6 | B | 53 | B | 40 | B |
| Ex 39 | 15 | B | 1.4 | B | 85 | B | 1.5 | B | 54 | B | 38 | B |
| Ex 40 | 13 | B | 1.2 | B | 87 | B | 1.7 | B | 65 | A | 25 | A |
| Ex 41 | 14 | B | 1.3 | B | 86 | B | 1.7 | B | 53 | B | 40 | B |
| Ex 42 | 12 | B | 1.4 | B | 88 | B | 1.8 | B | 50 | B | 50 | B |
| Ex 43 | 13 | B | 1.3 | B | 87 | B | 1.9 | B | 57 | B | 33 | B |
| Ex 44 | 14 | B | 1.3 | B | 86 | B | 1.8 | B | 52 | B | 44 | B |
| Ex 45 | 14 | B | 1.3 | B | 86 | B | 1.9 | B | 55 | B | 39 | B |
| Ex 46 | 13 | B | 1.2 | B | 87 | B | 1.9 | B | 54 | B | 40 | B |
| Ex 47 | 12 | B | 1.1 | B | 88 | B | 1.8 | B | 51 | B | 49 | B |
| Ex 48 | 11 | B | 1.1 | B | 89 | B | 1.9 | B | 51 | B | 48 | B |
| Ex 49 | 13 | B | 1.2 | B | 87 | B | 1.9 | B | 50 | B | 50 | B |

| | | | Production conditions | | | |
|---|---|---|---|---|---|---|
| | Alloy No. | Process No. | [10] Temp. raising speed (° C./min) | [13] Temp. lowering speed (° C./min) | [16] Temp. raising speed (° C./min) | [19] [11] to [18] repetition times (times) |
| CEx 11 | 21 | a | 1 | 1 | 1 | 2 |
| CEx 12 | 22 | a | 1 | 1 | 1 | 2 |
| CEx 13 | 23 | a | 1 | 1 | 1 | 2 |
| CEx 14 | 24 | a | 1 | 1 | 1 | 2 |
| CEx 15 | 25 | a | 1 | 1 | 1 | 2 |
| CEx 16 | 26 | a | 1 | 1 | 1 | 2 |
| CEx 17 | 27 | a | 1 | 1 | 1 | 2 |
| CEx 18 | 28 | a | 1 | 1 | 1 | 2 |
| CEx 19 | 29 | a | 1 | 1 | 1 | 2 |
| CEx 20 | 30 | a | 1 | 1 | 1 | 2 |
| CEx 21 | 31 | a | 1 | 1 | 1 | 2 |
| CEx 22 | 32 | a | 1 | 1 | 1 | 2 |
| CEx 23 | 33 | a | 1 | 1 | 1 | 2 |
| CEx 24 | 34 | a | 1 | 1 | 1 | 2 |
| CEx 25 | 35 | a | 1 | 1 | 1 | 2 |
| CEx 26 | 36 | a | 1 | 1 | 1 | 2 |
| CEx 27 | 37 | a | 1 | 1 | 1 | 2 |
| CEx 28 | 38 | a | 1 | 1 | 1 | 2 |
| CEx 29 | 39 | a | 1 | 1 | 1 | 2 |
| CEx 30 | 40 | a | 1 | 1 | 1 | 2 |
| CEx 31 | 41 | a | 1 | 1 | 1 | 2 |
| CEx 32 | 7 | A | 1 | 1 | 1 | 1 |
| CEx 33 | 9 | A | 1 | 1 | 1 | 1 |
| CEx 34 | 10 | A | 1 | 1 | 1 | 1 |

| | Texture characteristics | | | | | | | | | | | |
|---|---|---|---|---|---|---|---|---|---|---|---|---|
| | Amount of existence of fine-grains X % | Judge-ment | a/b size of grain Y | Judge-ment | Amount of existence of grains Y % | Judge-ment | Residual strain after cycles % | Judge-ment | Amount of existence of grains Z % | Judge-ment | Difference of stress MPa | Judge-ment |
| CEx 11 | Impposible to produce | | | | | | | | | | | |
| CEx 12 | Impposible to produce | | | | | | | | | | | |

TABLE 4-continued

| | | | | | | | | | | | | |
|---|---|---|---|---|---|---|---|---|---|---|---|---|
| CEx 13 | Impposible to produce | | | | | | | | | | | |
| CEx 14 | Impposible to produce | | | | | | | | | | | |
| CEx 15 | Impposible to produce | | | | | | | | | | | |
| CEx 16 | 13 | B | 1.4 | B | 87 | B | 2.9 | C | 55 | B | 38 | B |
| CEx 17 | Impposible to produce | | | | | | | | | | | |
| CEx 18 | Impposible to produce | | | | | | | | | | | |
| CEx 19 | Impposible to produce | | | | | | | | | | | |
| CEx 20 | Impposible to produce | | | | | | | | | | | |
| CEx 21 | 11 | B | 1.4 | B | 89 | B | 2.8 | C | 52 | B | 45 | B |
| CEx 22 | Impposible to produce | | | | | | | | | | | |
| CEx 23 | 12 | B | 1.3 | B | 88 | B | 2.9 | C | 53 | B | 42 | B |
| CEx 24 | 11 | B | 1.1 | B | 89 | B | 2.8 | C | 51 | B | 48 | B |
| CEx 25 | 10 | B | 1.1 | B | 82 | C | 3.0 | C | 51 | B | 49 | B |
| CEx 26 | Impposible to produce | | | | | | | | | | | |
| CEx 27 | 13 | B | 1.4 | B | 80 | C | 3.1 | C | 51 | B | 47 | B |
| CEx 28 | 12 | B | 1.1 | B | 80 | C | 2.9 | C | 50 | B | 48 | B |
| CEx 29 | 11 | B | 1.2 | B | 75 | C | 2.5 | C | 50 | B | 49 | B |
| CEx 30 | Impposible to produce | | | | | | | | | | | |
| CEx 31 | 10 | B | 1.1 | B | 80 | C | 2.9 | C | 50 | B | 39 | B |
| CEx 32 | 21 | C | 2.5 | A | 75 | C | 2.3 | C | 53 | B | 40 | B |
| CEx 33 | 21 | C | 2.5 | A | 70 | C | 2.3 | C | 53 | B | 40 | B |
| CEx 34 | 21 | C | 2.5 | A | 70 | C | 2.3 | C | 53 | B | 40 | B |

As is apparent from the results described above, in Examples 1 to 49, since the crystal grain size and the texture orientation defined in the present invention are satisfied, the resistance to repeated deformations of superelasticity, and the difference of stress between a 5% strain and a 0.2% strain, are excellent. Further, as described above, it was also confirmed that the orientation of the crystal grains (Y and Z) immediately after [Step 5-4] was consistent with the orientation of coarse crystal grains (Y' and Z') after the final heat treatment ([Step 5-10]).

Contrary to the above, each of the Comparative Examples resulted in the results in which any of the characteristics was poor.

Among these, in Comparative Examples 1 to 10 shown in Table 3-1 to Table 3-2, and Comparative Examples 32 to 34 shown in Table 4-2, production itself was impossible (Comparative Example 8); at least one condition of the crystal grain size or the texture orientation as defined in the present invention was not satisfied (Comparative Examples other than Comparative Example 8); and the resistance to repeated deformations of superelasticity was poor. In Comparative Examples 9 and 10, the difference of stress was also poor. These are all Comparative Examples with respect to the production method of the present invention. In Comparative Example 8, the intermediate annealing temperature was too low, and disconnection occurred. On the other hand, in Comparative Example 9, the intermediate annealing temperature was too high, and the texture orientation could not be controlled as desired.

Further, since all of Comparative Examples 11 to 31 shown in Table 4-2 did not satisfy the predetermined alloy composition defined in the present invention, the production itself of the materials was impossible (Comparative Examples 11 to 15, 17 to 20, 22, 26, and 30), or although the conditions for the crystal grain size or the texture orientation defined in the present invention were satisfied, the resistance to repeated deformations of superelasticity was poor (Comparative Examples other than Comparative Examples 11 to 15, 17 to 20, 22, 26, and 30).

It can be seen from the results described above that, even if a desired texture could be formed, if the alloy material is not produced under conditions in which the retention at temperature ranges [8] and [14] for obtaining an ($\alpha+\beta$) phase for predetermined times [9] and [15] in [Step 5-2] or [Step 5-6], the speeds of temperature raising [10] and [16] in [Step 5-3] and [Step 5-7], the speed of temperature lowering [13] in [Step 5-5], and the number of repetitions [19] of temperature lowering and temperature raising in [Step 5-9] are appropriately satisfied, it is difficult to cause coarsening of crystal grains Y (including crystal grains Z) while the texture is maintained, and to control the amount of existence of crystal grains X to be at a low level. Thus, the crystal grain size or the texture defined in the present invention cannot be satisfied, the difference of stress becomes small (low in characteristics of vibration damping), and the resistance to repeated deformations of superelasticity becomes poor.

Further, the test results were omitted but not shown. However, for the cases of the Cu—Al—Mn-based alloy materials of the present invention, which had the preferred alloy compositions within the ranges defined in the present invention other than those described in Tables 1-1 and 1-2, and for the cases of the sheets (strips) but not the rods (wires), the similar results as those of Examples can be obtained.

Having described our invention as related to the present embodiments, it is our intention that the invention not be limited by any of the details of the description, unless otherwise specified, but rather be construed broadly within its spirit and scope as set out in the accompanying claims.

REFERENCE SIGNS LIST

1 Cu—Al—Mn-based alloy rod material (wire material) of the present invention

2 Crystal Grain X

3 Crystal Grain Y' and Z', in the final state (crystal grains Y and Z in the state of the mid course)

R Alloy material width or rod material (wire material) diameter

RD Working direction of alloy material (wire-drawing direction of rod material (wire material))

The invention claimed is:

1. A Cu—Al—Mn-based alloy material having a composition comprising 3.0 to 10.0 mass % of Al, 5.0 to 20.0 mass % of Mn, and 0.000 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.000 to 3.000 mass %;

the content of Co is 0.000 to 2.000 mass %;

the content of Ti is 0.000 to 2.000 mass %;

the contents of V, Nb, Mo, and Zr are each 0.000 to 1.000 mass %;

the content of Cr is 0.000 to 2.000 mass %;

the content of Si is 0.000 to 2.000 mass %;

the content of W is 0.000 to 1.000 mass %;

the content of Sn is 0.000 to 1.000 mass %;

the content of Mg is 0.000 to 0.500 mass %;

the content of P is 0.000 to 0.500 mass %;

the contents of Be, Sb, Cd, and As are each 0.000 to 1.000 mass %;

the content of Zn is 0.000 to 5.000 mass %;

the contents of B and C are each 0.000 to 0.500 mass %;

the content of Ag is 0.000 to 2.000 mass %; and the content of misch metal is 0.000 to 5.000 mass %;

with the balance being Cu and unavoidable impurities, wherein the alloy material has a shape that is elongated in a working direction;

the working direction is a rolling direction or a wire-drawing direction;

the alloy material has a width or a diameter R;

an amount of existence of crystal grains X is 15% or less of the total amount of the alloy material;

the crystal grains X have a crystal grain length $a_x$ in the working direction of the alloy material which is R/2 or less and have a crystal grain length $b_x$ in a direction perpendicular to the working direction which is R/4 or less;

an amount of existence of the crystal grains Y' is 85% or more of the total amount of the alloy material; and the crystal grains Y' have a crystal grain length a in the working direction and a crystal grain length b, which is equal to R, in the direction perpendicular to the working direction, wherein a and b satisfy the relationships of a≥b, and an angle formed by the normal line of the (111) plane of crystals of the crystal grains Y' in the alloy material and the working direction is 15° or larger.

2. The Cu—Al—Mn-based alloy material according to claim 1, wherein the Cu—Al—Mn alloy material has the composition comprising 0.001 to 10.000 mass % in total of at least one selected from the group consisting of Ni, Co, Fe, Ti, V, Cr, Si, Nb, Mo, W, Sn, Mg, P, Be, Sb, Cd, As, Zr, Zn, B, C, Ag, and misch metal, where the contents of Ni and Fe are each 0.001 to 3.000 mass %; the content of Co is 0.001 to 2.000 mass %; the content of Ti is 0.001 to 2.000 mass %; the contents of V, Nb, Mo, and Zr are each 0.001 to 1.000 mass %; the content of Cr is 0.001 to 2.000 mass %; the content of Si is 0.001 to 2.000 mass %; the content of W is 0.001 to 1.000 mass %; the content of Sn is 0.001 to 1.000 mass %; the content of Mg is 0.001 to 0.500 mass %; the content of P is 0.010 to 0.500 mass %; the contents of Be, Sb, Cd, and As are each 0.001 to 1.000 mass %; the content of Zn is 0.001 to 5.000 mass %; the contents of B and C are each 0.001 to 0.500 mass %; the content of Ag is 0.001 to 2.000 mass %; and the content of misch metal is 0.001 to 5.000 mass %.

3. A rod material or a sheet material, which is formed from the Cu—Al—Mn-based alloy material according to claim 1.

* * * * *